US006676529B2

(12) United States Patent
Pernal

(10) Patent No.: US 6,676,529 B2
(45) Date of Patent: Jan. 13, 2004

(54) AMUSEMENT RAMP SYSTEM

(76) Inventor: John Pernal, 519 Revilo Blvd., Daytona Beach, FL (US) 32118

( * ) Notice: Subject to any disclaimer, the term of this patent is extended or adjusted under 35 U.S.C. 154(b) by 0 days.

(21) Appl. No.: 10/192,035

(22) Filed: Jul. 9, 2002

(65) Prior Publication Data

US 2003/0119590 A1 Jun. 26, 2003

Related U.S. Application Data

(60) Provisional application No. 60/343,487, filed on Dec. 21, 2001, now abandoned.

(51) Int. Cl.[7] ..... A63C 19/10
(52) U.S. Cl. ..... 472/89; 14/16.5
(58) Field of Search ..... 472/88, 89, 90, 472/91; 14/695, 71.1; 52/183

(56) References Cited

U.S. PATENT DOCUMENTS

| | | | | |
|---|---|---|---|---|
| 2,224,405 A | * | 12/1940 | McInyre | 446/107 |
| 2,927,396 A | | 3/1960 | Hall, Jr. | |
| 3,564,790 A | | 2/1971 | Rehfeld | |
| 4,129,916 A | | 12/1978 | Schlesinger et al. | |
| 4,285,514 A | | 8/1981 | Romero | |
| 5,033,146 A | * | 7/1991 | Fogarty et al. | 14/69.5 |
| 5,524,310 A | | 6/1996 | Farnen | |
| 5,566,622 A | | 10/1996 | Ziaylek, Jr. et al. | |
| 5,599,235 A | | 2/1997 | Lynberg | |
| D390,621 S | | 2/1998 | Cosentino | |
| 5,946,756 A | | 9/1999 | Mapp | |
| 6,042,480 A | | 3/2000 | Labelson | |

* cited by examiner

*Primary Examiner*—Kien T. Nguyen
(74) *Attorney, Agent, or Firm*—Robert P. Michal; Frishauf, Holtz, Goodman & Chick, P.C.

(57) ABSTRACT

Ramp system including one or more individual ramp components. Each ramp component includes a board defining an active ramp surface and a frame including a pair of substantially identical side panels, each having at least one board supporting edge including notches, and a support structure extending between and engaging with the notches in the side panels to support the board. The support structure provide supports for the board between the side panels and includes a cross-piece support extending between aligned pairs of notches in the board supporting edges of the side panels and a cross-piece extending between each aligned pair of notches in the board supporting edges of the side panels over a respective cross-piece support. Cross-pieces extend between other edges of the side panels to enable the ramp component to be connected to other ramp components, either by attachment of cross-pieces of the two ramp components together with fasteners, by attachment of the cross-pieces of one ramp component to the side panel of another ramp component by fasteners or by attachment of the side panel of one ramp component to the side panel of another ramp component by fasteners.

33 Claims, 15 Drawing Sheets

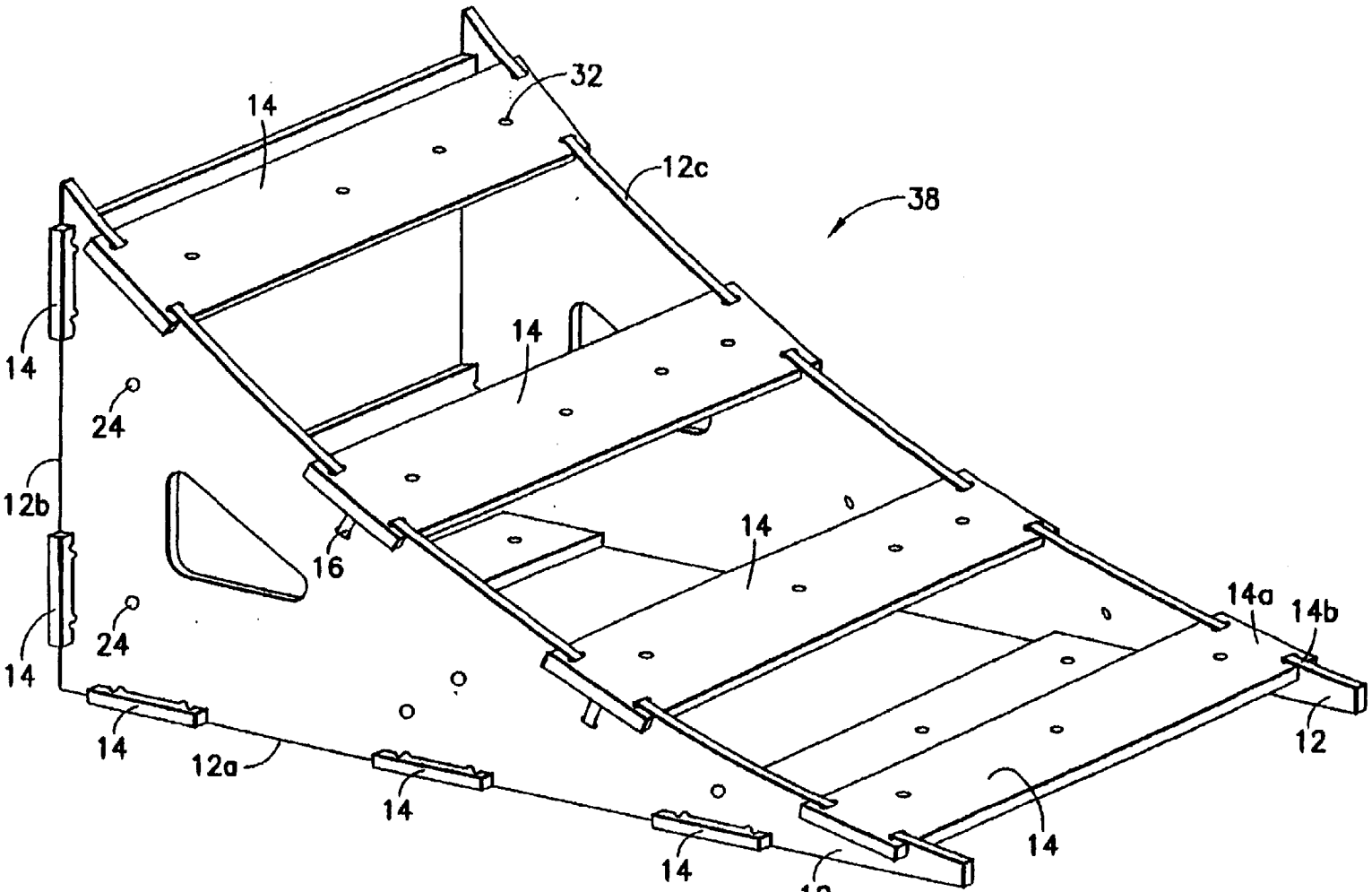
38
32
12c
14
14
14

AMUSEMENT RAMP SYSTEM

CROSS-REFERENCE TO RELATED APPLICATIONS

The present application claims priority under 35 USC 119(e) of Provisional Application Serial No. 60/343,487 filed Dec. 21, 2001 now abandoned, the entire contents of which are incorporated herein by reference.

FIELD OF THE INVENTION

This invention relates generally to amusement ramps for skateboarding, in-line skating, bicycle riding, snowboarding, snowskating and other related sport activities.

The invention also relates to individual components having various forms and which can be selectively connected together to form amusement ramps, support structures for supporting objects, decking systems for decks and the like.

BACKGROUND OF THE INVENTION

There are several types of amusement ramps in the prior art. One type is a self-standing, unitary structure such as described in U.S. Pat. No. 5,946,756 (Mapp). Mapp shows a molded plastic ramp made in a one-step molding process and including reinforced side and rear walls and a smooth ramp surface. Side and rear supports are provided to support the ramp.

Another type is a multi-component ramp wherein the components are assembled together to form the ramp such as described in U.S. Pat. No. 6,042,480 (Labelson). The ramp of Labelson includes a pair of side frames and ramp sections supported by the side frames and defining an active ramp surface. The side frames includes ramp supporting surfaces having locating tabs to cooperate with locking notches on the ramp section to secure the ramp sections to the side frames and notches in which crossbraces are positioned to provide support for the ramp sections. The ramp is not designed to connect to other ramps and thus it is limited to the configuration shown.

Other multi-component ramps are described in U.S. Pat. Nos. 3,564,790 (Rehfeld), 4,129,916 (Schlesinger et al.) and 5,524,310 (Farnen). These ramps do not include individual ramp components defining an active ramp surface which are connectable to one another to form various configurations of ramps.

OBJECTS OF THE INVENTION

It is an object of the present invention to provide an amusement ramp system which comprises individual ramp components which are easy to assemble and can be connected to one another.

It is another object of the present invention to provide a ramp system including individual ramp components which can be assembled in different configurations.

It is another object of the present invention to provide a ramp system which comprises a number of interconnected components whereby each component can be easily and quickly assembled and disassembled.

It is yet another object of the present invention to provide a ramp system including a frame and a board which is designed to be easily attached and detached from the frame. This enables various ramps to be used for different uses and desires, with the change from one board to another being easy and quick.

It is still another object of the present invention to provide a ramp system capable of both land and water uses, the water uses being provided by the design of a frame to enable flotation devices to be attached to the underside of the frame.

Another object of the present invention is to provide a decking system, support structure and platform assembly which comprise individual components which are easy to assemble and can be connected to one another in different configurations.

Still another object of the present invention is to provide a new construction of individual, self-standing components having various forms and which can be selectively connected together to form amusement ramps, support structures for supporting objects, decking systems for decks and the like.

SUMMARY OF THE INVENTION

In order to achieve objects of the invention, an amusement ramp system in accordance with the invention comprises one or more ramp components or modules which can be connected together. Each ramp component is an independent unit made of several parts and can be sold as a kit including the required number and type of parts. Some of the parts are used in all of the ramp components.

Generally, the basic ramp component includes a board defining an active ramp surface and a frame consisting of a pair of substantially identical side panels, each having at least one board supporting edge including notches and a support structure extending between and engaging with the notches in the side panels to support the board. The frame also preferably includes a connection structure extending between and engaging with notches in other edges of the side panels and is designed to enable connection to the support structure or side panels of other ramp components. The side panels also include an appropriate connection structure which enables the side panels of different ramp components to be connected together to thereby provide for a laterally expanded ramps. As such, the ramp components can be connected together to form different configurations of ramps by a connection between a side panel of one ramp component and a connection structure of another ramp component, by a connection between a side panel of one ramp component and a side panel of another ramp component (which may the same or a different ramp component) or by a connection between a connection structure of one ramp component and a connection structure of another ramp component.

The board supporting edge is designed to support a flat or curved board depending on the shape and construction of the side panel and board supporting edge. For example, if the side panels are triangular, then the board supporting edge constituting the hypotenuse of the side panels and board supported thereby could be flat to form a wedge-shaped ramp component or the board supporting edge and board supported thereby could be curved to form an arcuate ramp component. Further, if the side panels are rectangular and the board supporting edges therefore flat, then flat boards are supported by the board supporting edges to form box components. Such box components can be used as platforms or to extend or elevate the wedge-shaped or arcuate ramp components. In some embodiments of the ramp wherein the box components are used to support and elevate other ramp components, the box components do not include a board.

The support structure which provide supports for the board between the side panels includes a cross-piece support extending between each aligned pair of notches in the board supporting edges of the side panels and a cross-piece extending between each aligned pair of notches in the board supporting edges of the side panels over a respective cross-piece support. Thus, the cross-piece supports underlie the cross-pieces and enhance the support of the board provided by the cross-pieces. To enable placement of the cross-piece supports and cross-pieces in the notches, the cross-piece supports have an indentation at each end in the same edge and the cross-pieces have two indentations at each end in opposed edges.

The cross-pieces are connected to the side panels by appropriate connection or fastening members. The board is also connected to the cross-pieces by appropriate connection members such as fasteners which extend through aligning apertures in the board and the cross-pieces.

With respect to the connection structure, edges of the side panels other than the board supporting edge are designed as connection edges as the ramp component can be connected to another ramp component along these edges. To this end, the connection edges include notches. Cross-pieces extend between each aligned pair of notches and are fastened to the side panels. To connect ramp components together, the cross-pieces on one side of one ramp component are placed alongside the cross-pieces on one side of another ramp component such that apertures in the cross-pieces align and connection members are then inserted through the aligning apertures to connect the adjacent ramp components together via the cross-pieces. The cross-pieces of one ramp component can also be placed alongside a side panel of another ramp component so that apertures in the cross-pieces align with apertures in the side panel and connection members are insertable through the aligning apertures to fasten the cross-pieces to the side panel.

The connection structure of the side panels which enable each side panel to be attached to a side panel of another ramp component or to one or more cross-pieces of another ramp component includes apertures formed on the side panels of all of the ramp components at a common height and spacing and connection members adapted to pass through aligning apertures and fix adjacent side panels to one another or a side panel to an adjacent cross-piece. That is, the notches are formed in the connection edges of the side panels so that apertures in the cross-pieces placed in the notches will be at the same height and spacing as apertures in the side panels. Further, all of the side panels are constructed with apertures at the same height and spacing. As such, two ramp components can be connected together either by joining a cross-piece to a side panel, a cross-piece of one ramp component to a side panel of another ramp component or a side panel of one ramp component to a side panel of the other ramp component.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 2 is a view of the frame of the arcuate ramp component of the ramp system shown in FIG. 1A;

DETAILED DESCRIPTION OF THE INVENTION

Figure 1A:
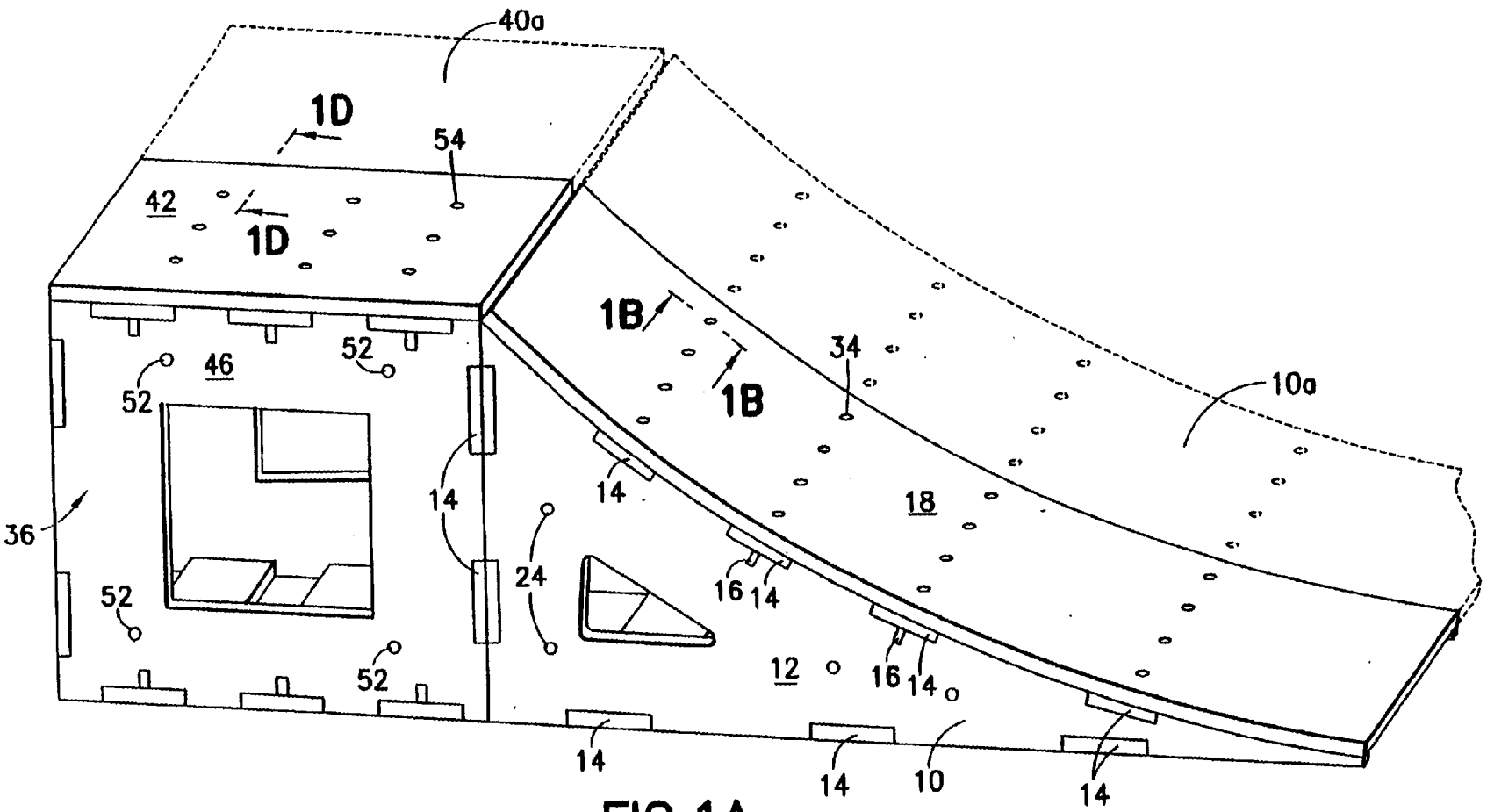
FIG. 1A is a perspective view of a ramp system in accordance with a first embodiment of the invention which consists of an arcuate ramp component and a first box component.
Figure 1B:
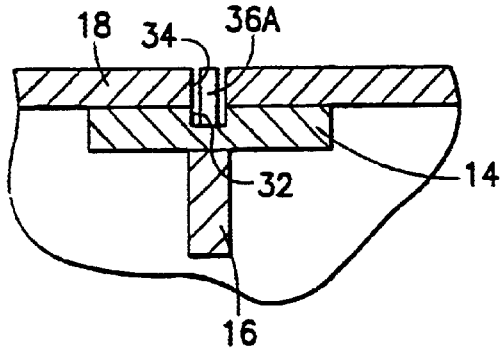
FIG. 1B is a cross-sectional view of the ramp system shown in FIG. 1A taken along the line 1B—1B in FIG. 1A.
Figure 1C:
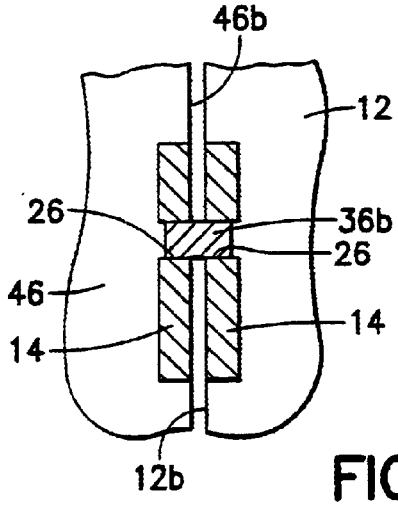
FIG. 1C is a cross-sectional view showing the attachment of adjacent cross-pieces in the ramp system shown in FIG. 1A.

The ramp system in accordance with the invention comprises a number of separate components, referred to as ramp components. These ramp components are assembled separate from one another. By selecting the type and number of ramp components, different ramp systems can be designed as desired, for example, to fit within a specific area or for use in a particular sport such as in-line skating. Each ramp component is described separately below.

Generally though, each ramp component includes a board defining an active ramp surface and a frame comprising two side panels, a support structure connected to the side panels for supporting the board and a connection structure connected to the side panels for enabling connection of the ramp component to another ramp component. The support structure comprises cross-pieces extending between the side panels for connecting the side panels together and cross-piece supports for supporting the cross-pieces. The connection structure also comprises cross-pieces constructed to enable their connection to the cross-pieces of another component. Similarly, the side panels are constructed to enable their connection to the side panels of another component. As such, ramp systems can be formed from assemblies of different ramp components by connecting side panels of several ramp components together, connecting the cross-pieces of several ramp components together, and side panels to cross-pieces. Preferably the side panels are interchangeable such that each can function as, for example, the left or the right side panel. In addition it is foreseen that each of the cross-pieces used for the ramp system of the present invention could be interchangeable or specific depending upon the specific construction of the system.

The board is actually an optional element which can be connected to the cross-pieces of the support structure when it is desired to have the ramp component define an active ramp surface. At times, the ramp component does not define an active ramp surface but rather serves as a support for other ramp components, and thus in these instances, the board is not used.

Referring now to FIGS. 1A–9, a first ramp system in accordance with the invention includes two ramp components, an arcuate ramp component 10 and a small box component 40. Arcuate ramp component 10 provides a curved slope or ramp and includes a curved board 18 and a frame 38 comprised of opposed side panels 12, a support structure comprised of cross-pieces 14 which extend between the side panels 12 and cross-piece supports 16 which extend between the side panels 12 under the cross-pieces 14 and a connection structure comprised of cross-pieces 14. The curved board 18 is arranged on the cross-pieces 14 of the support structure and has the same curvature as the side panels 12 so that the board 18 rests on the upper, board supporting edges of the side panels 12 and on the cross-pieces 14.

Figure 3:
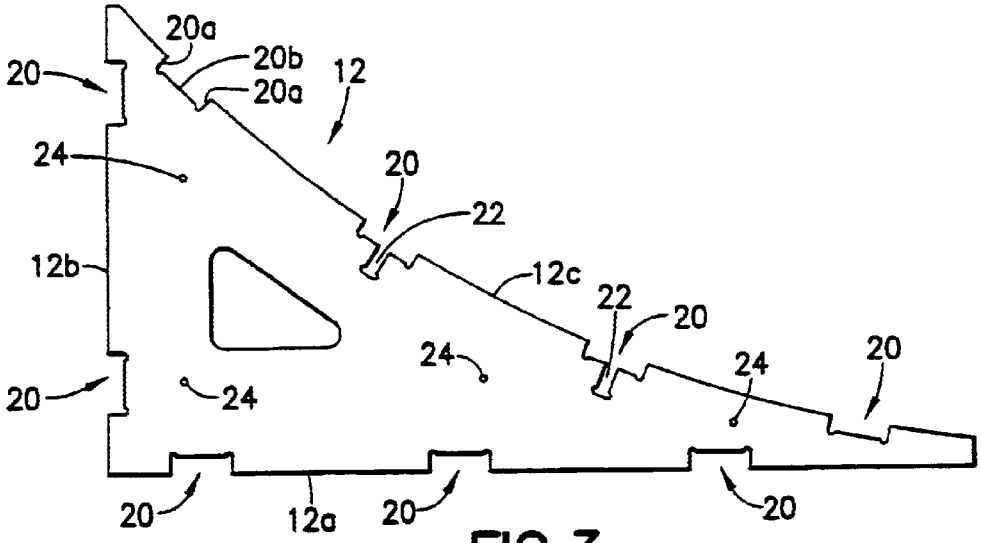
FIGS. 3–6 show the elements of the arcuate ramp component shown in FIG. 2.

A side panel 12 is shown in FIG. 3 and includes a generally flat lower edge 12*a,* a generally flat side edge 12*b* and an arcuate upper edge 12*c.* The arcuate upper edge 12*c* is a board supporting edge in this embodiment as the board 18 will be supported partly thereby. The lower edge 12*a* and side edge 12*b* are connection edges which can be placed alongside edges of another ramp component and connected to the other ramp component via the cross-pieces 14 as described more fully below.

Figure 4:
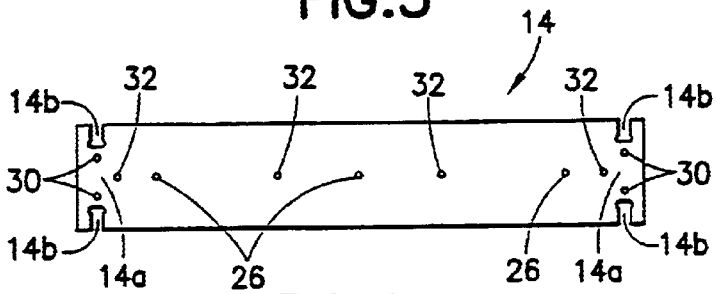
Figure 5:
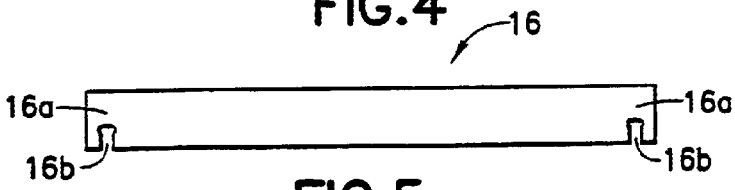
Figure 6:
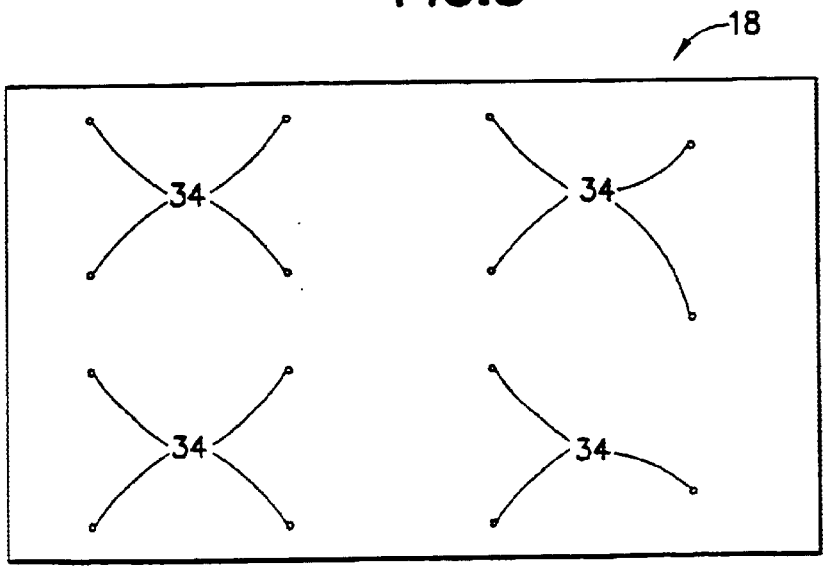

Notches 20 are formed in the lower edge 12*a,* side edge 12*b* and upper edge 12*c,* each notch 20 being sized to receive an indented part 14*a* of a respective cross-piece 14 (see FIG. 4). In the illustrated embodiment, the notches 20 are substantially rectangular in cross-section as the indented part 14*a* of the cross-pieces 14 is substantially rectangular. Each notch 20 includes opposed surfaces 20*a* extending substantially perpendicular to the edge 12*a,* 12*b*, 12*c* of the side panel 12 in which it is formed and a flat surface 20*b* which is substantially parallel to the edge 12*a,* 12*b*, 12*c* of the side panel 12 in which the notch 20 is formed. The depth of the notches 20 is substantially equal to the width of the cross-pieces 14 so that the cross-pieces 14 are flush with the edges 12*a,* 12*b*, 12*c* of the side panels 12 (see FIG. 2).

As shown in FIGS. 2 and 3, the lower edge 12*a* includes three notches 20, the side edge 12*b* includes two notches 20 and the upper edge 12*c* includes four notches 20. However, the number and spacing of the notches 20 can be varied, for example, for larger side panels, the number of notches 20 should be increased.

Notches 22 are formed in the flat surfaces 20*b* of some of the notches 20 formed in the upper edge 12*c* of the side panels 12. Each notch 22 is sized to receive an indented part 16*a* of a respective cross-piece support 16 (see FIG. 5). In the illustrated embodiment, the notches 22 are substantially rectangular in cross-section as the indented part 16*a* of the cross-piece supports 16 is substantially rectangular. The combination of notches 20,22 forms a substantially T-shaped recess in the upper edge 12*c* of the side panels 12 with the cross-piece support 16 being placed in the leg of the "T" and the cross-piece 14 being placed over the cross-piece support 16 in the top of the "T".

The side panels 12 and cross-pieces 14 include apertures 24 and 26, respectively, at pre-determined locations to enable attachment of the arcuate ramp component 10 to other ramp components. For example, two arcuate ramp components 10 can be connected to one another side by side via apertures 24 in adjacent side panels 12 to thereby provide a ramp system having a ramp twice the width of the board 18 (a second arcuate ramp component 10A is shown in dotted lines in FIG. 1A). The arcuate ramp component 10 is connected to box components described below via the apertures 26 in the cross-pieces 14 or via the apertures 24 in the side panel 12. To facilitate interconnection of side panels of different ramp components, the apertures 24 are set at a standard height and spacing so that by placing the apertures in the side panels of the other ramp components at the same height and spacing, the apertures in the side panels can be aligned with one another and the side panels of different ramp components connected together using appropriate connection or fastening members. Furthermore, the notches 20 of side panel 12 and the side panels of other ramp components discussed below are formed at pre-determined locations along the side edges of the side panels so that the apertures 26 in the cross-pieces 14 placed in the notches will also preferably be at the same height and spacing as the apertures 24 in the side panel 12 (as well as the apertures in side panels of other ramp components) (note the placement of the apertures 24 at a level which is in an approximate center of the notches 20). As such, connection between a side panel 12 and a side panel or cross-piece 14 of another, possibly different ramp component is possible.

Each cross-piece 14 is in the form of a plank having broad upper and lower substantially rectangular surfaces, narrow side edges coextensive with the broad surfaces and narrow lateral end surfaces. The cross-pieces 14 can be made of wood, plastic or another suitable material with indentations 14*b* being formed during manufacture or cut out after manufacture to thereby form the indented part 14*a* between the indentations 14*b*.

The cross-pieces 14 also include apertures 30 in the indented parts 14*a* between the indentations 14*b* which enable the cross-pieces 14 to be securely attached to the side panels 12 by screws, nails and other similar attachment members (see FIG. 4).

Each cross-piece support 16 is in the form of a plank having broad upper and lower substantially rectangular surfaces, narrow side edges coextensive with the broad surfaces and narrow lateral end surfaces. The cross-piece supports 16 can be made of wood, plastic or another suitable material with indentations 16*b* being formed during manufacture or cut out after manufacture to thereby form the indented part 16*a* between the indentations 16*b*.

Instead of separate cross-pieces 14 and cross-piece supports 16, a single unitary member can be provided and designed to fit within the combined notches 20,22 in the side panels. In the alternative, the cross-pieces 14 and cross-piece supports 16 can be formed separately but attached to one another prior to sale of a kit containing the required elements to assemble the arcuate ramp component 10.

At least some of the cross-pieces 14 also include apertures 32 positioned to align with apertures 34 in the board 18. These cross-pieces 14 are thus placed in the notches 20 in the upper edge 12*c* of the side panels 12. During assembly of the arcuate ramp component 10, countersunk connection members 36*a* such as screws, nails and the like are placed in the aligning apertures 32,34 to securely attach the board 18 to the cross-pieces 14 placed in the notches 20 formed in the upper edges 12*c* of the side panels 12 (see FIG. 1B). The use of countersunk connection members 36*a* keeps the active ramp surface smooth.

The cross-piece supports 16 include indentations 16*b* along one longitudinal edge, one proximate each end, and have a flat opposite edge. Further, the cross-piece supports 16 are dimensioned so that when the cross-piece supports 16 fit into the notches 22, the upper, longitudinal edge is substantially flush with the lower surface 20*b* of the notch 20 thereby provide a flat surface adapted to receive a cross-piece 14.

Board 18 is dimensioned to overlie substantially the entire side edge 12*c* of each side panel 12. Also, the longitudinal edges of the board 18 are preferably shaped to enable easy access to skateboards and the like.

The side panels 12, cross-pieces 14, cross-piece supports 16 and board 18 (as well as the necessary fastening or connection members) are preferably sold together as a kit, with an appropriate number of each part to enable a complete arcuate ramp component 10 to be assembled. Thus, a kit to assemble the arcuate ramp component 10 would include two side panels 12, nine cross-pieces 14, two cross-piece supports 16 and a single board 18. If notches 22 are formed in more than two notches 20, then additional cross-piece supports 16 would be provided as the number of cross-piece supports 16 should equal the number of notches 22.

To assemble the arcuate ramp component 10 from the kit, the frame 38 is first assembled. To this end, the side panels 12 are stood upright with the upper edge 12*c* of the side panels 12 facing upward and the cross-piece supports 16 are placed in the notches 22. Cross-pieces 14 are then placed in the notches 20 over the cross-piece supports 16. The fit between the cross-pieces 14 and the notches 20 is a snug fit so that the cross-pieces 14 are actually snapped into the notches 20. Preferably though, fastening members are inserted through apertures 30 in the cross-pieces 14 to firmly secure the cross-pieces 14 to the side panels 12. The side panels 12 are then rotated until the lower edge 12*a* and side edge 12*b* are facing upward. Cross-pieces 14 are snapped into the notches 20 in the lower and side edges 12*a*, 12*b* of the side panels 12 and preferably fastened to the side panels 12 using fastening members. The frame 38 is thus complete and then turned over until the upper edge 12*c* faces upward. The board 18 is then placed over the cross-pieces 14 until apertures 34 align with apertures 32 and then fastening members are inserted through the aligning apertures to secure the board 18 to the cross-pieces 14. The arcuate ramp component 10 is thus complete and ready for use.

Figure 7:
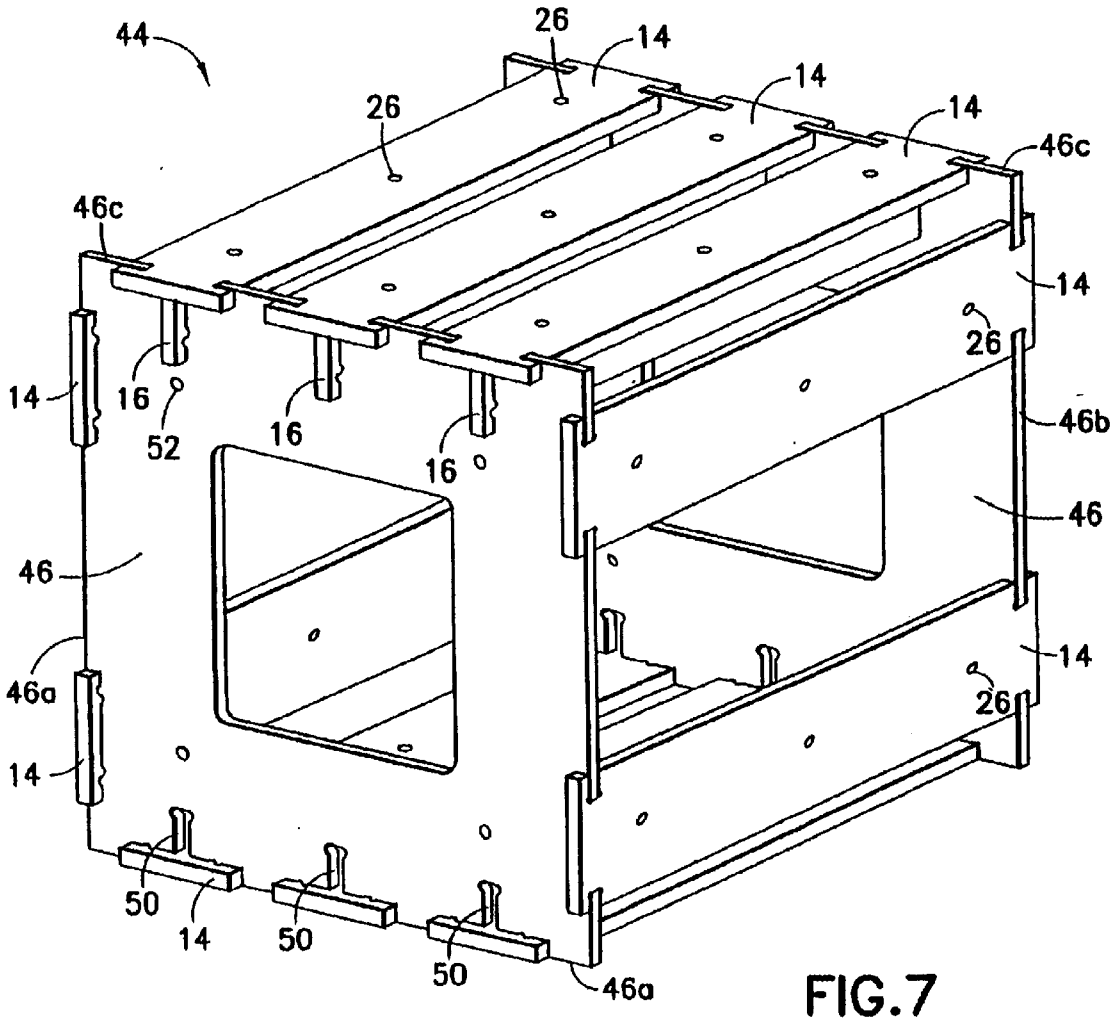
FIG. 7 shows the frame of the first box component of the ramp system shown in FIG. 1A.
Figure 8:
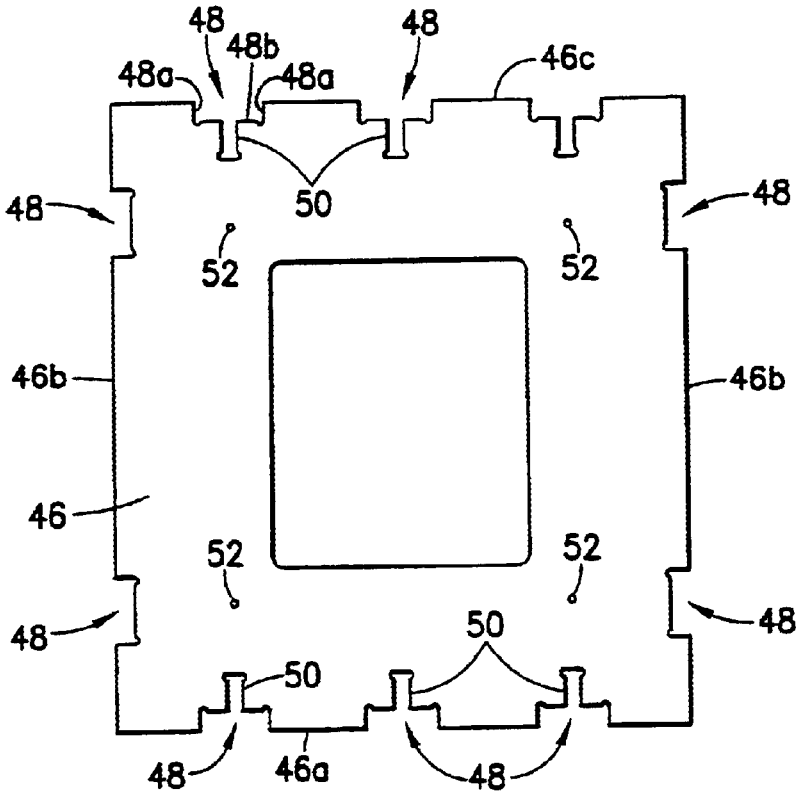
FIGS. 8 and 9 show elements of the first box component shown in FIG. 7.
Figure 9:
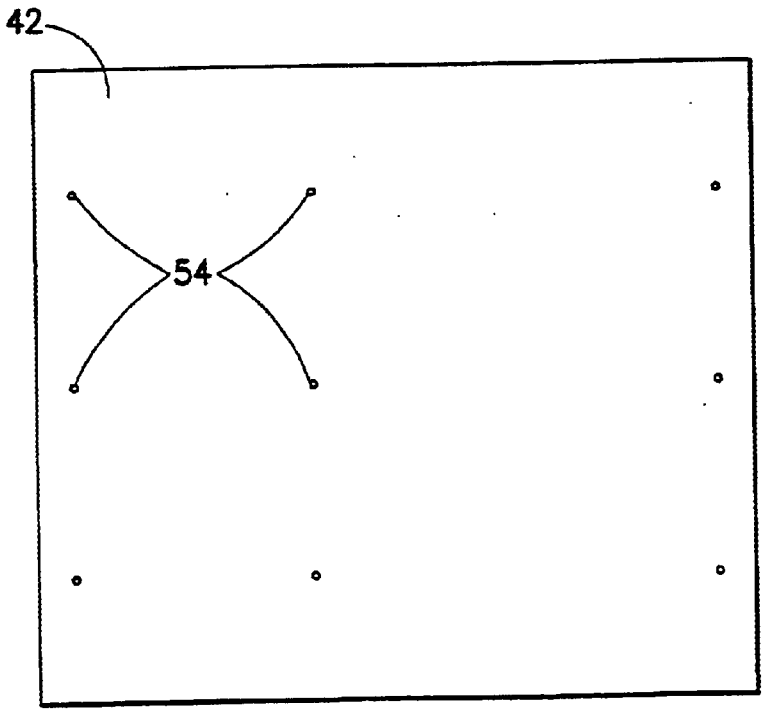

Referring now in particular to FIGS. 7–9, the small box component 40 is referred to as a small box component because it is smaller than another box component discussed below. The small box component 40 has opposed parallel sides and can be connected to other ramp components along any of its sides.

Small box component 40 provides a flat, elevated platform and includes a planar board 42 and a frame 44 comprised of opposed, square side panels 46, a support structure for supporting the board 42 which is comprised of cross-pieces 14 which extend between the side panels 46 and cross-piece supports 16 which extend between the side panels 46 under the cross-pieces 14, and a connection structure comprised of cross-pieces 14. The support structure is arranged on one side of the frame 44 and the connection structure encompasses the remaining sides of the frame 44 so that as shown, at least one cross-piece 14 is situated on each side of the frame 44. Board 42 can be connected to the cross-pieces 14 as discussed below and is optional in that it is not used when the small box component 40 is used as a support for another ramp component.

The cross-pieces 14 and cross-pieces supports 16 are the same as those used in the arcuate ramp component 10 and are described above.

The height of side panels 46 is substantially the same as the height of the smaller side of the side panels 12. This enables the formation of the ramp system shown in FIG. 1A without any significant bumps at the transition of the ramp surface between the board 18 and the board 42.

Side panels 46 each have a flat lower edge 46*a*, flat side edges 46*b* and a flat upper edge 46*c*. Notches 48 are formed in the lower edge 46*a*, side edges 46*b* and upper edge 46*c*, each notch 48 being sized to receive an indented part 14*a* of a respective cross-piece 14. Each notch 48 includes opposed surfaces 48*a* extending substantially perpendicular to the edge 46*a*, 46*b*, 46*c* of the side panel 46 in which it is formed and a flat surface 48*b* which is substantially parallel to the edge 46*a*, 46*b*, 46*c* of the side panel 46 in which the notch 48 is formed.

As shown, the lower edge 46*a* includes three notches 48 in order to receive three cross-pieces 14, the side edges 46*b* each include two notches 48 in order to receive two cross-pieces 14 and the upper edge 46*c* includes four notches 48 in order to receive four cross-pieces 14. The number and spacing of the notches 48 can be varied as discussed above.

Notches 50 are formed in the flat surface 48*b* of the notches 48 formed in the lower and upper edges 46*a*, 46*c* of the side panels 46. Each notch 50 is sized to receive the indented part 16*a* of a respective cross-piece support 16. The combination of notches 48,50 forms a T-shaped recess in the lower and upper edges 46*a*, 46*c* of the side panels 46.

The side panels 46 also include apertures 52 at predetermined locations to enable attachment of the small box component 40 to other ramp components, either to the side panels of other ramp components or to cross-pieces of other ramp components. FIG. 1A shows a second small box component 40A in dotted lines attached to the small box component 40 via the side panels 46. Connection of the side panels 46 to the side panels of other, possibly different ramp components is facilitated by the appropriate placement of the apertures 52 at the same height and spacing as the apertures in the side panels of the other ramp components, e.g., the apertures 24 in side panel 12. Connection of the side panels 46 to cross-pieces of other, possibly different ramp components is facilitated by the placement of the notches 48 of the side panel 46 and the notches in the side panels of other ramp components at pre-determined locations along the edges of the side panels so that the apertures 26 in the cross-pieces 14 placed in the notches will also preferably be at the same height and spacing as the apertures 52 in the side panel 46 (as well as the apertures in side panels of other ramp components). As such, connection between a side panel 46 and a side panel or cross-piece 14 of another, possibly different ramp component is possible.

As shown in FIG. 1A, the board 42 is dimensioned to overlie substantially the entire upper edge 46*c* of each side panel 46. Board 42 is provided with apertures 54 which are designed to align with apertures 32 in the cross-pieces 14 of the support structure. During assembly of the small box component 40, countersunk connection members such as screws, nails and the like are placed in the aligning apertures 32,54 to securely attach the board 42 to the cross-pieces 14 placed in the notches 48 formed in the upper edges 46*c* of the side panels 46.

The side panels 46, cross-pieces 14, cross-piece supports 16 and board 42 (as well as the necessary fastening or connection members) are preferably sold together as a kit, with an appropriate number of each part to enable a complete small box component 40 to be assembled. Thus, a kit to assemble the small box component 40 would include two side panels 46, ten cross-pieces 14, three cross-piece supports 16 and a single board 42. Note that although both the upper and lower edges 46*a*,46*c* include notches 50, only one edge constitutes a board supporting edge in the illustrated embodiment so only three cross-piece supports 16 are provided in the kit. It is understood though that each frame 44 can have no board-supporting edges, i.e., when it is used as to elevate another ramp component in which case either no notches 50 are formed in the side panels 46 or no cross-pieces 16 are used if such notches 50 are present, or one or more board supporting edges in which case a sufficient amount of cross-pieces supports are provided to enable one to be placed in each notch 50.

To assemble the small box component 40 from the kit, the frame 44 is first assembled. To this end, the side panels 46 are stood upright with the upper edge 46*c* of the side panels 46 facing upward and the cross-piece supports 16 are placed in the notches 50. Cross-pieces 14 are then placed in the notches 48 over the cross-piece supports 16. Preferably fastening members are inserted through apertures 30 in the cross-pieces 14 to firmly secure the cross-pieces 14 to the side panels 46. The side panels 46 are then rotated until the lower edge 46*a* faces upward. Cross-pieces 14 are snapped into the notches 48 in the lower edge 46*a* of the side panels 46 and preferably fastened to the side panels 46 using fastening members. The side panels 46 are rotated until the side edges 46*b* are facing upward and cross-pieces 14 inserted therein and fastened. It will be appreciated that cross-pieces 14 can be snapped into the notches 48 in the side edges 46*b* even when the lower edge 46*a* or upper edge 46*c* faces upward. The frame 44 is thus complete and is as shown in FIG. 7. To complete assembly of the small box component 40, the frame 44 is turned over until the upper edge 46*c* faces upward. The board 42 is then placed over the cross-pieces 14 until apertures 54 align with apertures 32 and then fastening members are inserted through the aligning apertures to secure the board 42 to the cross-pieces 14. The small box component 40 is thus complete and ready for use.

To attach the arcuate ramp component 10 and small box component 40 together, the arcuate ramp component 10 is placed with its larger edge on the ground and the small box component 40 is placed alongside the smaller edge of the arcuate ramp component 10 so that the apertures 26 in the cross-pieces 14 along the smaller edge align with apertures 26 in the cross-pieces 14 placed in the notches in a side connection edge 46*b* of the side panels 46 of the small box component 40. Fastening members 36*b* are inserted through the aligning apertures to securely connect a cross-piece 14 of the arcuate ramp component 10 and a cross-piece 14 of the small box component 40 together (see FIG. 1C). To disassemble the ramp system, the fastening members 36*b* are removed or untightened and the arcuate ramp component 10 separated from the small box component 40. The arcuate ramp component 10 and small box component 40 can then be used for other ramp systems.

In the alternative, it is possible to connect the arcuate ramp component 10 and the small box component 40 together alongside one another with the side panel 12 of the arcuate ramp component being alongside the side panel 46 of the small box component 40. The apertures 24 in the side panel 12 will align with the apertures 52 in the side panel 46 in view of the preferably standard height and spacing of apertures in the side panels of the ramp components disclosed herein.

Figure 1D:
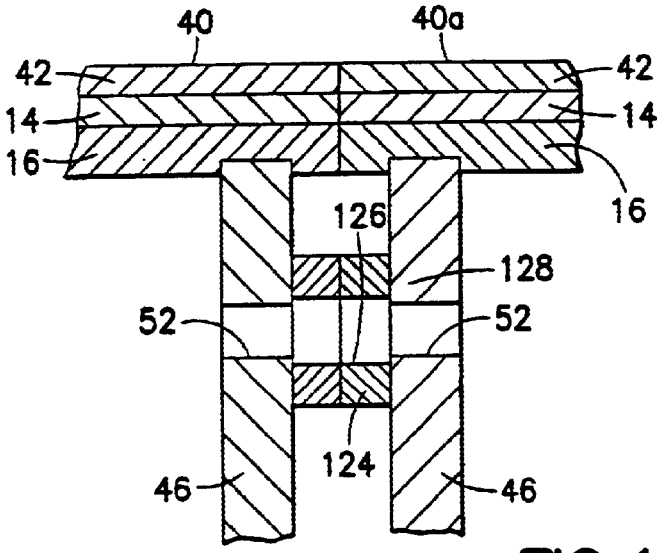
FIG. 1D is a cross-sectional view showing the attachment of adjacent side panels in the ramp system shown in FIG. 1A.

When attaching ramp components together via side panels, a space is usually present between the side panels in view of an overhang of the cross-pieces over the side panels. For example, cross-pieces 14 overhang the side panel 12 of the arcuate ramp component 10 in view of the presence of the indentations 14*b*, i.e., the indentations 14*b* in the illustrated embodiment are not formed at the edges of the cross-pieces 14 but rather inward therefrom. Forming the indentations 14*b* inward from the edges provides for a quicker assembly of the ramp components since the cross-pieces 14 can be attached to the side panels without any attachment or fastening members extending through apertures 30. In view of the presence of the overhang, spacers 124 are preferably provided to span the distance between the adjacent side panels (see FIG. 1D). As shown in FIG. 1D, a cross-sectional view of the attachment of two side panels 46 of adjacent small box components 40,40A, the cross-pieces 14, as well as the cross-piece supports 16 and board 42, overhang the side panel 46 so that the side panels 46 are spaced from one another a distance equal to twice the overhang. To compensate for this spacing, a pair of spacers 124 are provided, one spacer 124 being attached to each side panel 46, for example, by screws or other comparable attachment devices 128. Each spacer 124 is substantially tubular and has an aperture 126 in alignment with the aperture 52 in the side panel 46. As such, fastening members can be inserted through the apertures 52 in the adjacent side panels 46 and through the apertures 126 in the spacers 124. The use of spacers 124 is optional in that the fastening members for attaching the side panels 46 together can be designed to sufficiently rigid so as not to require support in the span between the adjacent side panels 46.

In order to avoid the need for spacers 124, it is possible to construct the ramp components without any overhang in which case, there would not be any significant space between side panels of adjacent ramp components. This would likely require the use of fastening members to attach the cross-pieces 14 to the side panels, via apertures 30 in the cross-pieces 14.

Referring now to FIGS. 10–16, a second ramp system in accordance with the invention includes two ramp components, a wedge component 60 and a large box component 62. Wedge component 60 provides a straight ramp and includes a flat board 64 and a frame 66 comprised of opposed, substantially triangular side panels 68, a board support structure comprised of cross-pieces 14 which extend between the side panels 68 and cross-piece supports 16 which extend between the side panels 68 under the cross-pieces 14 and a connection structure comprised of support pieces 14. The board 64 is arranged on the cross-pieces 14 of the support structure and rests on the upper edges of the side panels 68. The cross-pieces 14 and cross-pieces supports 16 are the same as those used in the arcuate ramp component 10 and are described above.

Figure 11:
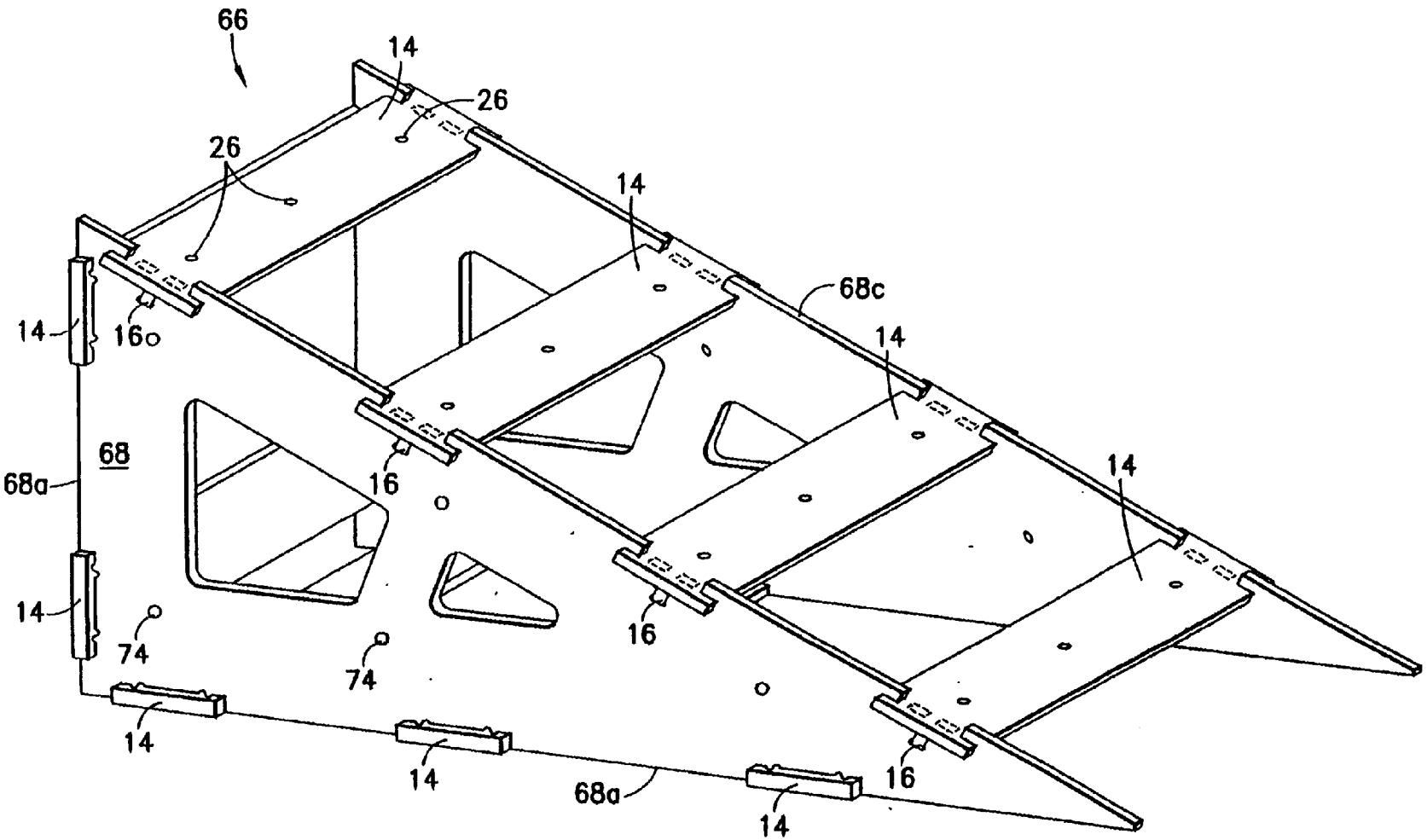
FIG. 11 is a view of the frame of the wedge ramp component of the ramp system shown in FIG. 10.
Figure 12:
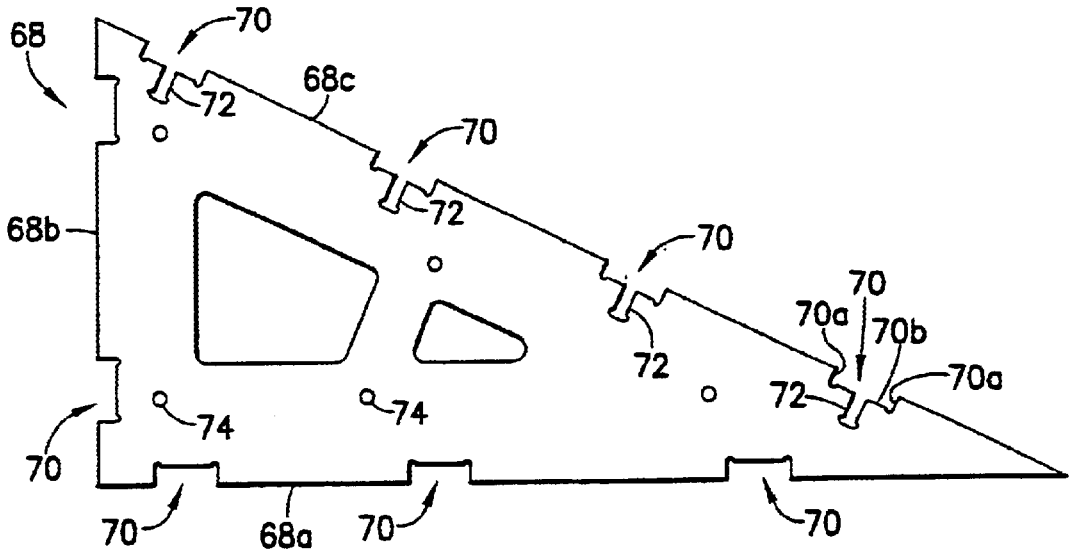
FIGS. 12 and 13 show elements of the wedge ramp component shown in FIG. 11.

As shown in FIGS. 11 and 12, the side panels 68 are substantially triangular and have a flat lower edge 68*a*, a flat side edge 68*b* and a flat upper edge 68*c*. The flat upper edge 68*c* is a board supporting edge in this embodiment as the board 64 will be supported partly thereby. The lower edge 68*a* and side edge 68*b* are connection edges which can be placed alongside edges of another ramp component and connected to the other ramp component via the cross-pieces 14.

Notches 70 are formed in the lower edge 68*a*, side edge 68*b* and upper edge 68*c*, each notch 70 being sized to receive an indented part 14*a* of a respective cross-piece 14. In the illustrated embodiment, the notches 70 are substantially rectangular in cross-section as the indented part 14*a* of the cross-pieces 14 is substantially rectangular. Each notch 70 includes opposed surfaces 70*a* extending substantially perpendicular to the edge 68*a,* 68*b,* 68*c* of the side panel 68 in which it is formed and a flat surface 70*b* which is substantially parallel to the edge 68*a,* 68*b,* 68*c* of the side panel 68 in which the notch 70 is formed. The depth of the notches 70 may be substantially equal to the width of the cross-pieces 14 so that the cross-pieces 14 are flush with the edges 68*a,* 68*b,* 68*c* of the side panels 68 or larger than the width of the cross-pieces 14 as shown in FIG. 11.

As shown in FIG. 12, the lower edge 68*a* includes three notches 70 in order to receive three cross-pieces 14, the side edge 68*b* includes two notches 70 in order to receive two cross-pieces 14 and the upper edge 68*c* includes four notches 70 in order to receive four cross-pieces 14. The number and spacing of the notches 70 can be varied as discussed above.

Notches 72 are formed in the flat surfaces 70*b* of the notches 70 formed in the upper edge 68*c* of the side panels 68. Each notch 72 is sized to receive an indented part 16*a* of a respective cross-piece support 16. In the illustrated embodiment, the notches 72 are substantially rectangular in cross-section as the indented part 16*a* of the cross-piece supports 16 is substantially rectangular. The combination of notches 70,72 forms a T-shaped indentation in the upper edge 68*c* of the side panels 68 with the cross-piece support 16 being placed in the leg of the "T" and the cross-piece 14 being placed over the cross-piece support 16 in the top of the "T".

The side panels 68 include apertures 74 at pre-determined locations to enable attachment of the wedge component 60 to other components. For example, two wedge components 60 can be connected to one another side by side via apertures 74 in adjacent side panels 68 to thereby provide a ramp system having a ramp twice the width of the board 64. The wedge component 60 can also be connected to box components or the arcuate ramp component 10 via the apertures 26 in the cross-pieces 14.

The height of side panels 68 is substantially the same as the height of the smaller side of the side panels 12 of the arcuate ramp component 10, as well as the height of the side panels 46 of the small box component 40. This enables the formation of ramp systems from combinations of the wedge component 60, the arcuate ramp component 10 and the small box component 40. For example, a ramp system can be formed consisting of the small box component 40 and the wedge component 60, similar to that shown in FIG. 1A, but with a wedge component 60 instead of the arcuate ramp component 10. It is important to maintain common dimensions between the different ramps components in order to enable the components to be placed side by side without significant bumps at transitions between the ramp sections or board provided by the components.

Figure 10:
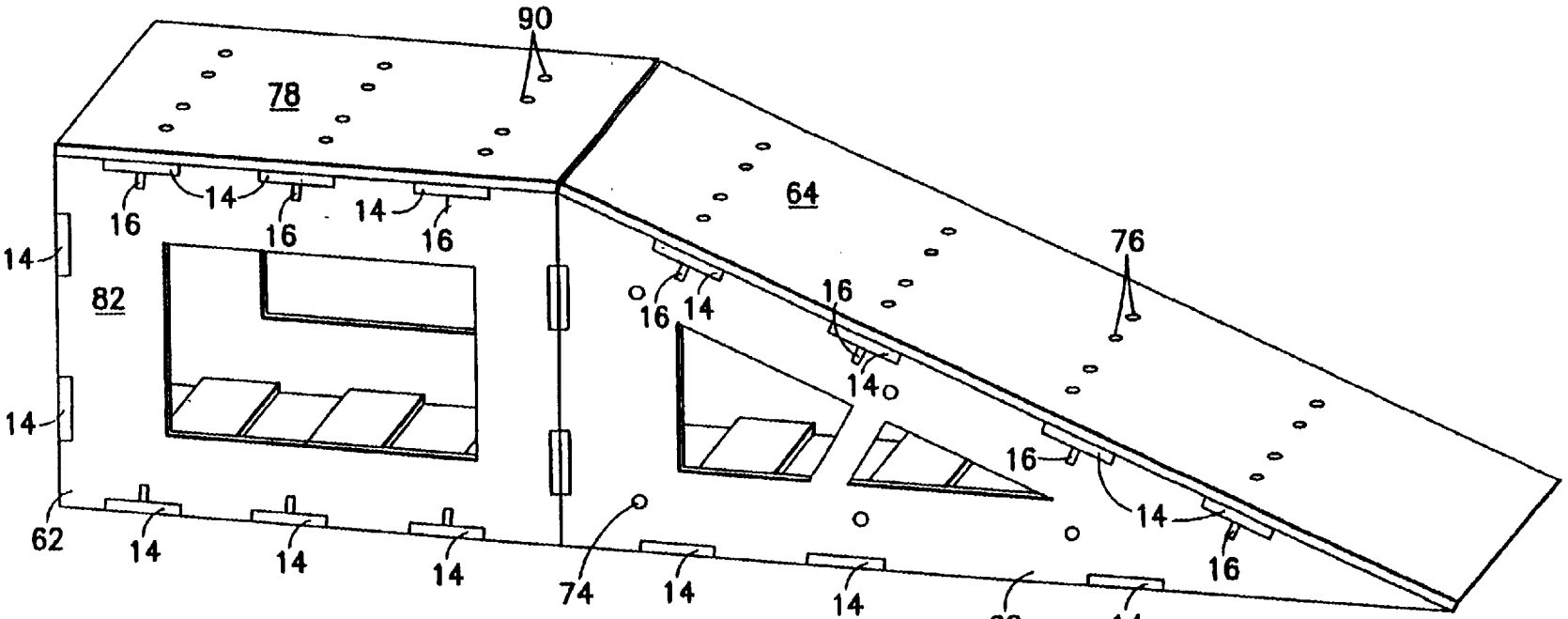
FIG. 10 is a perspective view of a ramp system in accordance with a second embodiment of the invention which consists of a wedge ramp component and a second box component.

As shown in FIG. 10, the board 64 is dimensioned to overlie substantially the entire upper edge 68*c* of each side panel 68. Also, the longitudinal edges of the board 64 are preferably shaped to enable easy access to skateboards and the like.

Figure 13:
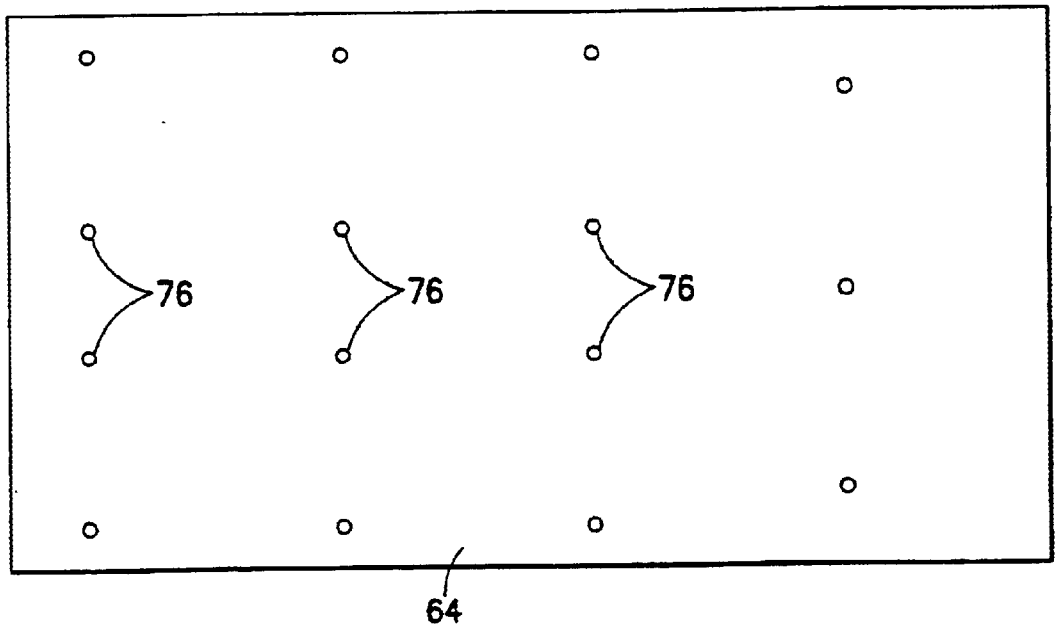

As shown in FIG. 13, board 64 is provided with apertures 76 which are designed to align with apertures 32 in the cross-pieces 14. During assembly of the wedge component 60, countersunk connection members such as screws, nails and the like are placed in the aligning apertures 32,76 to securely attach the board 64 to the cross-pieces 14 placed in the notches 70 formed in the upper edges 68*c* of the side panels 68.

The side panels 68, cross-pieces 14, cross-piece supports 16 and board 64 (as well as the necessary fastening or connection members) are preferably sold together as a kit, with an appropriate number of each part to enable a complete wedge component 60 to be assembled. Thus, a kit to assemble the wedge component 60 would include two side panels 68, nine cross-pieces 14, four cross-piece supports 16 and a single board 64.

To assemble the wedge component 60 from the kit, the frame 66 is assembled first. To this end, the side panels 68 are stood upright with the upper edge 68*c* of the side panels 68 facing upward and the cross-piece supports 16 are placed in the notches 72. Cross-pieces 14 are then snapped into in the notches 70 over the cross-piece supports 16 and preferably fastening members are inserted through apertures 30 in the cross-pieces 14 to firmly secure the cross-pieces 14 to the side panels 68. The side panels 68 are then rotated until the lower edge 68*a* and side edge 68*b* are facing upward. Cross-pieces 14 are snapped into the notches 70 in the lower and side edges 68*a,*68*b* of the side panels 68 and preferably fastened to the side panels 68 using fastening members. The frame 66 is thus complete and then turned over until the upper edge 68*c* faces upward. The board 64 is then placed over the cross-pieces 14 mounted in the notches 70 in the upper edge 68*c* of the side panels 68 until apertures 76 align with apertures 32 and then fastening members are inserted through the aligning apertures to secure the board 64 to the cross-pieces 14. The wedge component 60 is thus complete and ready for use.

Figure 14:
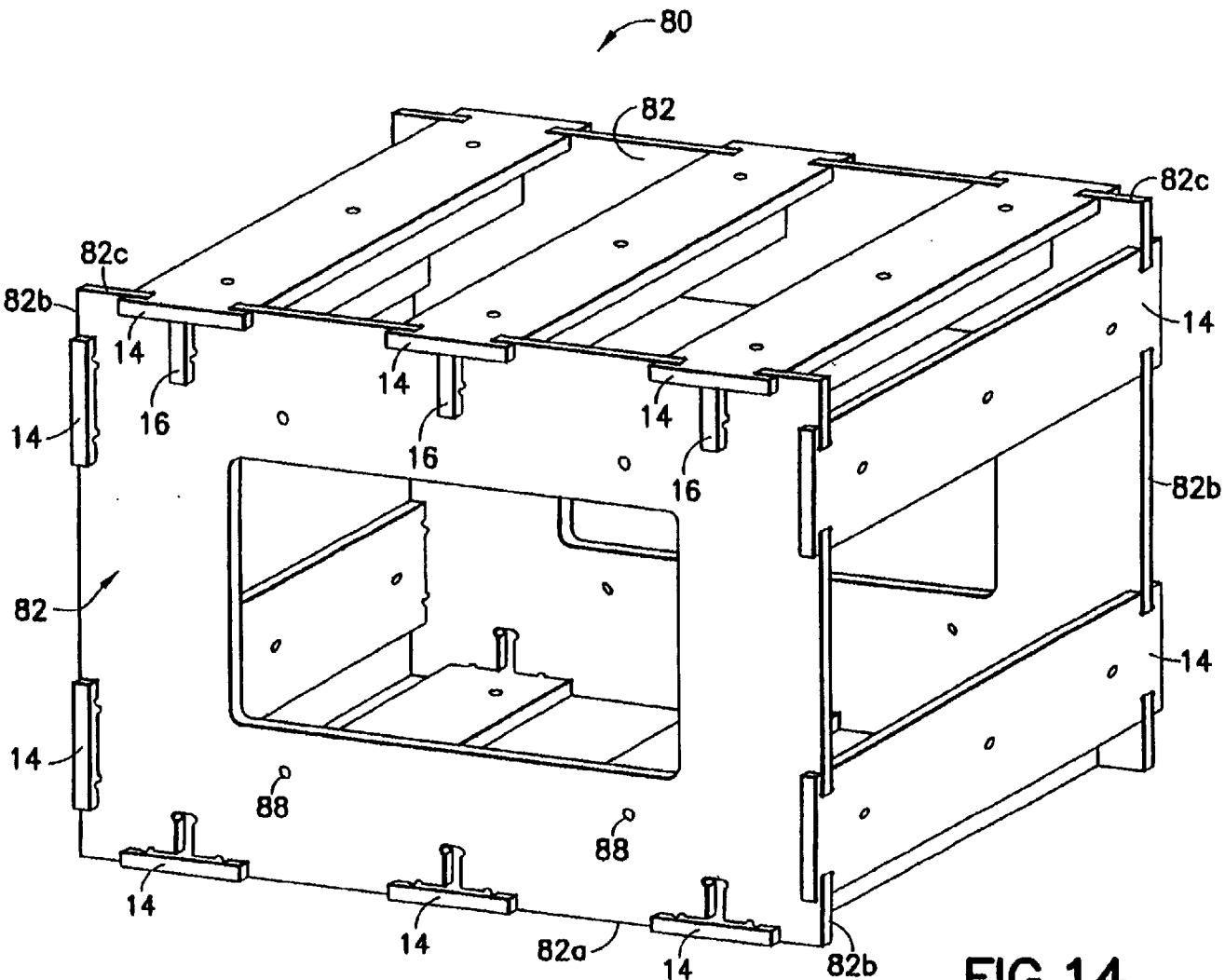
FIG. 14 shows the frame of the second box component of the ramp system shown in FIG. 10.
Figure 15:
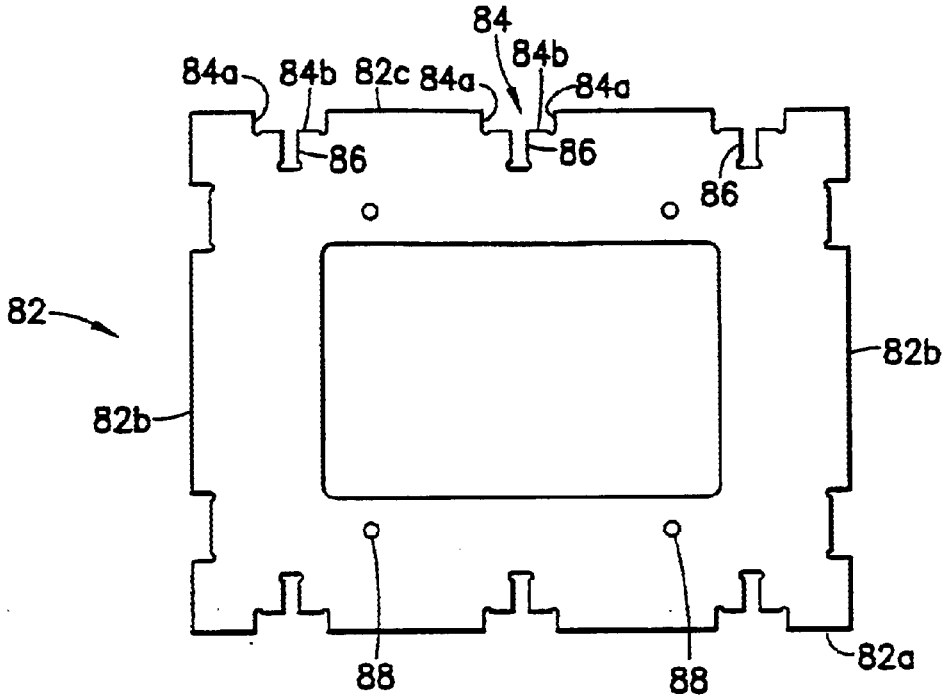
FIGS. 15 and 16 show elements of the second box component shown in FIG. 14.
Figure 16:
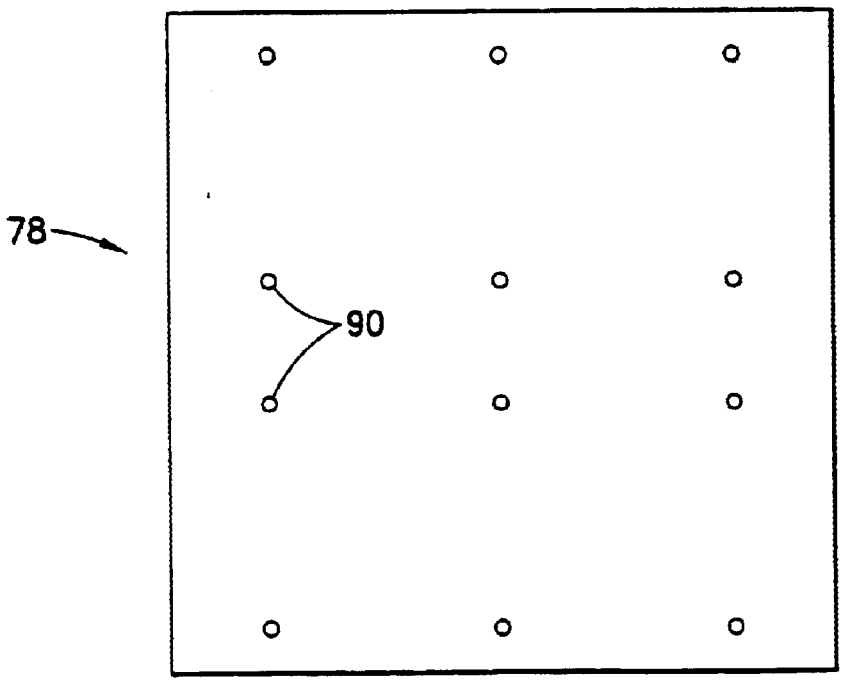

Referring now in particular to FIGS. 14–16, the large box component 62 is referred to as a large box component because it is larger than the small box component 40 discussed above. The large box component 62 has opposed parallel sides and can be connected to other ramp components along any of its sides.

Large box component 62 provides a flat, elevated platform and includes a planar board 78 and a frame 80 comprised of opposed, rectangular side panels 82, a support structure for supporting the board 78 which is comprised of cross-pieces 14 which extend between the side panels 82 and cross-piece supports 16 which extend between the side panels 82 under the cross-pieces 14, and a connection structure comprised of cross-pieces 14. The support structure is arranged on one side of the frame 80 and the connection structure encompasses the remaining sides of the frame 80 so that as shown, at least one cross-piece 14 is situated on each side of the frame 80. Board 78 can be connected to the cross-pieces 14 as discussed below and is optional in that it is not used when the large box component 62 is used as a support for another ramp component.

The cross-pieces 14 and cross-pieces supports 16 are the same as those used in the arcuate ramp component 10 and are described above.

The height of side panels 82 is substantially the same as the height of the smaller side of the side panels 12 of the arcuate ramp component 10, as well as the height of the side panels 46 of the small box component 40 and the side panels 68 of the wedge component 60. This enables the formation of ramp systems from various combinations of the large box component 62, the wedge component 60, the arcuate ramp component 10 and the small box component 40 such as the one shown in FIG. 10.

Side panels 82 each have a flat lower edge 82*a,* flat side edges 82*b* and a flat upper edge 82*c*. Notches 84 are formed in the lower edge 82*a,* side edges 82*b* and upper edge 82*c,* each notch 84 list being sized to receive an indented part 14*a* of a respective cross-piece 14. Each notch 84 includes opposed surfaces 84*a* extending substantially perpendicular to the edge 82*a,* 82*b,* 82*c* of the side panel 82 in which it is formed and a flat surface 84*b* which is substantially parallel to the edge 82*a,* 82*b,* 82*c* of the side panel 82 in which the notch 84 is formed.

As shown, the lower and upper edges 82*a,*82*c* each include three notches 84 in order to receive three cross-pieces 14 and the side edges 82*b* each include two notches 84 in order to receive two cross-pieces 14. The number and spacing of the notches 84 can be varied as discussed above.

Notches 86 are formed in the flat surface 84*b* of the notches 84 formed in the lower and upper edges 82*a,*82*c* of the side panels 82. Each notch 86 is sized to receive the indented part 16*a* of a respective cross-piece support 16. The combination of notches 84,86 forms a T-shaped recess in the lower and upper edges 82*a,* 82*c* of the side panels 82.

The side panels 82 also include apertures 88 at predetermined locations to enable attachment of the large box component 62 to other ramp components, for example, either to side panels of other ramp components or to cross-pieces of other ramp components (discussed below with reference to FIG. 23). Connection of the side panels 82 to the side panels of other ramp components is facilitated by the placement of the apertures 88 in all of the side panels at a common height and spacing.

As shown in FIG. 10, the board 78 is dimensioned to overlie substantially the entire upper edge 82*c* of each side panel 82. Board 78 is provided with apertures 90 which are designed to align with apertures 32 in the cross-pieces 14 of the support structure. During assembly of the large box component 62, countersunk connection members such as screws, nails and the like are placed in the aligning apertures 32,90 to securely attach the board 78 to the cross-pieces 14 placed in the notches 84 formed in the upper edges 82*c* of the side panels 82.

The side panels 82, cross-pieces 14, cross-piece supports 16 and board 78 (as well as the necessary fastening or connection members) are preferably sold together as a kit, with an appropriate number of each part to enable a complete large box component 62 to be assembled. Thus, a kit to assemble the large box component 62 would include two side panels 82, ten cross-pieces 14, three cross-piece supports 16 and a single board 78.

To assemble the large box component 62 from the kit, the frame 80 is first assembled. To this end, the side panels 82 are stood upright with the upper edge 82*c* of the side panels 82 facing upward and the cross-piece supports 16 are placed in the notches 86. Cross-pieces 14 are then placed in the notches 84 over the cross-piece supports 16. Preferably fastening members are inserted through apertures 30 in the cross-pieces 14 to firmly secure the cross-pieces 14 to the side panels 82. The side panels 82 are then rotated until the lower edge 82*a* faces upward. Cross-pieces 14 are snapped into the notches 84 in the lower edge 82*a* of the side panels 82 and preferably fastened to the side panels 82 using fastening members. The side panels 82 are rotated until the side edges 82*b* are facing upward and cross-pieces 14 inserted therein and fastened. It will be appreciated that cross-pieces 14 can be snapped into the notches 84 in the side edges 82*b* even when the lower edge 82*a* or upper edge 82*c* faces upward. The frame 80 is thus complete and is as shown in FIG. 14. To complete assembly of the large box component 62, the frame 80 is turned over until the upper edge 82*c* faces upward. The board 78 is then placed over the cross-pieces 14 until apertures 90 align with apertures 32 and then fastening members are inserted through the aligning apertures to secure the board 78 to the cross-pieces 14. The large box component 62 is thus complete and ready for use.

To attach the wedge component 60 and large box component 62 together, the wedge component 60 is placed with its larger edge on the ground and the large box component 62 is placed alongside the smaller edge of the wedge component 60 so that the apertures 26 in the cross-pieces 14 along the smaller edge align with apertures 26 in the cross-pieces 14 placed in the notches in a side connection edge 82*b* of the side panels 82 of the large box component 62. Fastening members are inserted through the aligning apertures to securely connect a cross-piece 14 of the wedge component 60 and a cross-piece 14 of the large box component 62 together (in a similar manner as shown by the connection of the cross-pieces in FIG. 1C). To disassemble the ramp system, the fastening members are removed or untightened and the wedge component 60 separated from the large box component 62. The wedge component 60 and large box component 62 can then be used for other ramp systems.

FIGS. 17–21 show side panels for use in other ramp components in accordance with the invention.

Figure 17:
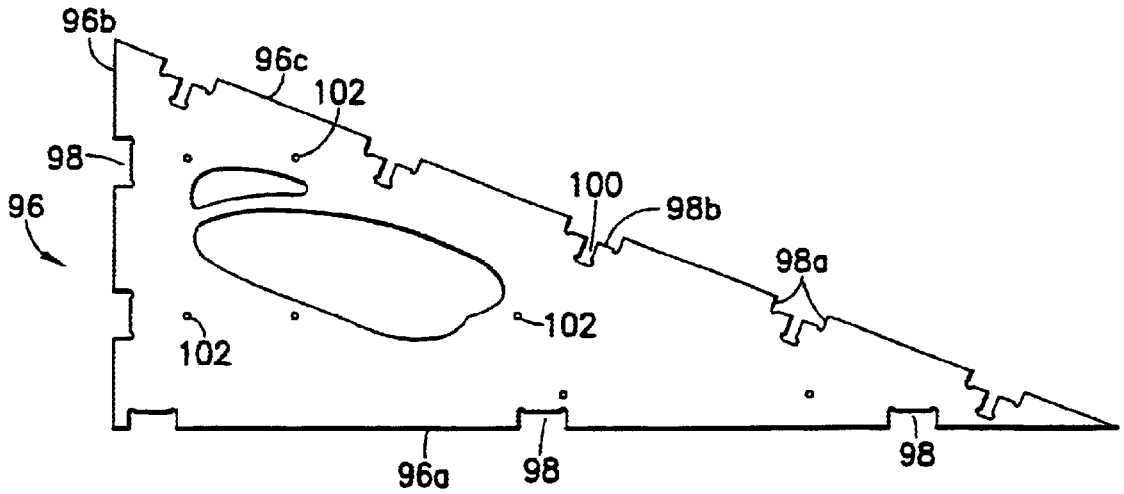
FIGS. 17–21 show side panels of additional ramp components in accordance with the invention.

FIG. 17 shows a side panel 96 of a "large" wedge component, i.e. a wedge component which is larger than the wedge component 60 shown in FIG. 10. The large wedge component provides a straight ramp and includes two side panels 96, a flat board substantially coextensive with the angled surface of the side panel 96, a board support structure comprised of cross-pieces 14 which extend between the side panels 96 and cross-piece supports 16 which extend between the side panels 96 under the cross-pieces 14 and a connection structure comprised of support pieces 14. The board is arranged on the cross-pieces 14 of the support structure and rests on the upper edges of the side panels 96. The cross-pieces 14 and cross-pieces supports 16 are the same as those used in the arcuate ramp component 10 and are described above.

The side panels 96 are substantially triangular and have a flat lower edge 96*a,* a flat side edge 96*b* and a flat upper edge 96*c*. The flat upper edge 96*c* is a board supporting edge as the board will be supported partly thereby. The lower edge 96*a* and side edge 96*b* are connection edges which can be placed alongside edges of another ramp component and connected to the other ramp component via the cross-pieces 14.

Notches 98 are formed in the lower edge 96*a,* side edge 96*b* and upper edge 98*c,* each notch 98 being sized to receive an indented part 14*a* of a respective cross-piece 14. The notches 98 are substantially rectangular in cross-section as the indented part 14*a* of the cross-pieces 14 is substantially rectangular. Each notch 98 includes opposed surfaces 98*a* extending substantially perpendicular to the edge 96*a,* 96*b,* 96*c* of the side panel 96 in which it is formed and a flat surface 98*b* which is substantially parallel to the edge 96*a,* 96*b,* 96*c* of the side panel 96 in which the notch 98 is formed. The depth of the notches 98 may be substantially equal to the width of the cross-pieces 14 so that the cross-pieces 14 are flush with the edges 96*a,* 96*b,* 96*c* of the side panels 96 or larger than the width of the cross-pieces 14.

The lower edge 96*a* includes three notches 98 in order to receive three cross-pieces 14, the side edge 96*b* includes two notches 98 in order to receive two cross-pieces 14 and the upper edge 96*c* includes five notches 98 in order to receive five cross-pieces 14. The number and spacing of the notches 98 can be varied as discussed above.

Notches 100 are formed in the flat surfaces 98*b* of the notches 98 formed in the upper edge 96*c* of the side panels 96. Each notch 100 is sized to receive an indented part 16*a* of a respective cross-piece support 16. In the illustrated embodiment, the notches 100 are substantially rectangular in cross-section as the indented part 16*a* of the cross-piece supports 16 is substantially rectangular. The combination of notches 98, 100 forms a T-shaped indentation in the upper edge 96*c* of the side panels 96 with the cross-piece support 16 being placed in the leg of the "T" and the cross-piece 14 being placed over the cross-piece support 16 in the top of the "T".

The side panels 96 include apertures 102 at predetermined locations to enable attachment of the large wedge component to other components. For example, two large wedge components can be connected to one another side by side via apertures 102 in adjacent side panels 96 to thereby provide a ramp system having a ramp twice the width of the board. The large wedge component can also be connected to cross-pieces or side panels of box components or the arcuate ramp component 10 via the apertures 26 in the cross-pieces 14.

The height of side panels 96 is substantially the same as the height of the smaller side of the side panels 12 of the arcuate ramp component 10, as well as the height of the side panels 46 of the small box component 40 and the height of the side panels 68 of the wedge component 60. This enables the formation of ramp systems from combinations of the large wedge component, the wedge component 60, the arcuate ramp component 10 and the small box component 40. For example, a ramp system can be formed consisting of the small box component 40 and the large wedge component, similar to that shown in FIG. 1A, but with a large wedge component instead of the arcuate ramp component 10.

The board of the large wedge component is dimensioned to overlie substantially the entire upper edge 96*c* of each side panel 96. Also, the longitudinal edges of the board are preferably shaped to enable easy access to skateboards and the like. Like for board 64 of wedge component 60, the board of the large wedge component (not shown) is provided with apertures which are designed to align with apertures 32 in the cross-pieces 14. During assembly of the large wedge component, countersunk connection members such as screws, nails and the like are placed in the aligning apertures to securely attach the board to the cross-pieces 14 placed in the notches 98 formed in the upper edges 96*c* of the side panels 96.

The side panels 96, cross-pieces 14, cross-piece supports 16 and board (as well as the necessary fastening or connection members) are preferably sold together as a kit, with an appropriate number of each part to enable a complete large wedge component to be assembled. Thus, a kit to assemble the large wedge component would include two side panels 96, ten cross-pieces 14, five cross-piece supports 16 and a single board.

To assemble the large wedge component from the kit, the frame is assembled first. To this end, the side panels 96 are stood upright with the upper edge 96*c* of the side panels 96 facing upward and the cross-piece supports 16 are placed in the notches 100. Cross-pieces 14 are then snapped into in the notches 98 over the cross-piece supports 16 and preferably fastening members are inserted through apertures 30 in the cross-pieces 14 to firmly secure the cross-pieces 14 to the side panels 96. The side panels 96 are then rotated until the lower edge 96*a* and side edge 96*b* are facing upward. Cross-pieces 14 are snapped into the notches 98 in the lower and side edges 96*a*, 96*b* of the side panels 68 and preferably fastened to the side panels 96 using fastening members. The frame is thus complete and then turned over until the upper edge 96*c* faces upward. The board is then placed over the cross-pieces 14 mounted in the notches 98 in the upper edge 96*c* of the side panels 96 until apertures in the board align with apertures 32 and then fastening members are inserted through the aligning apertures to secure the board to the cross-pieces 14. The large wedge component is thus complete and ready for use.

Figure 18:
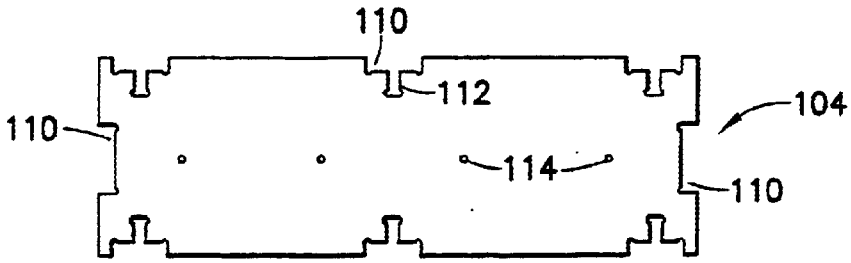
Figure 19:
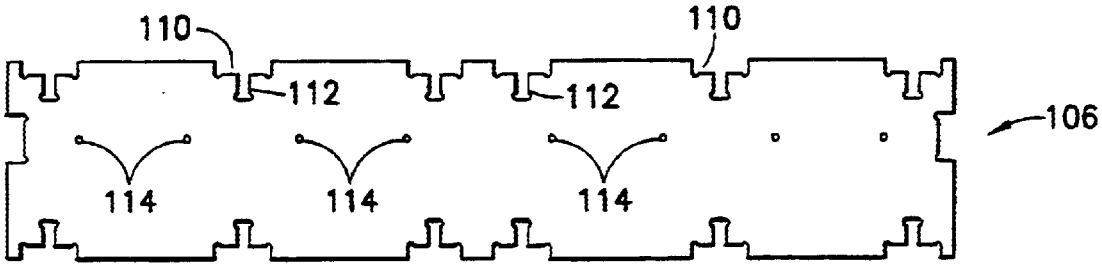
Figure 20:
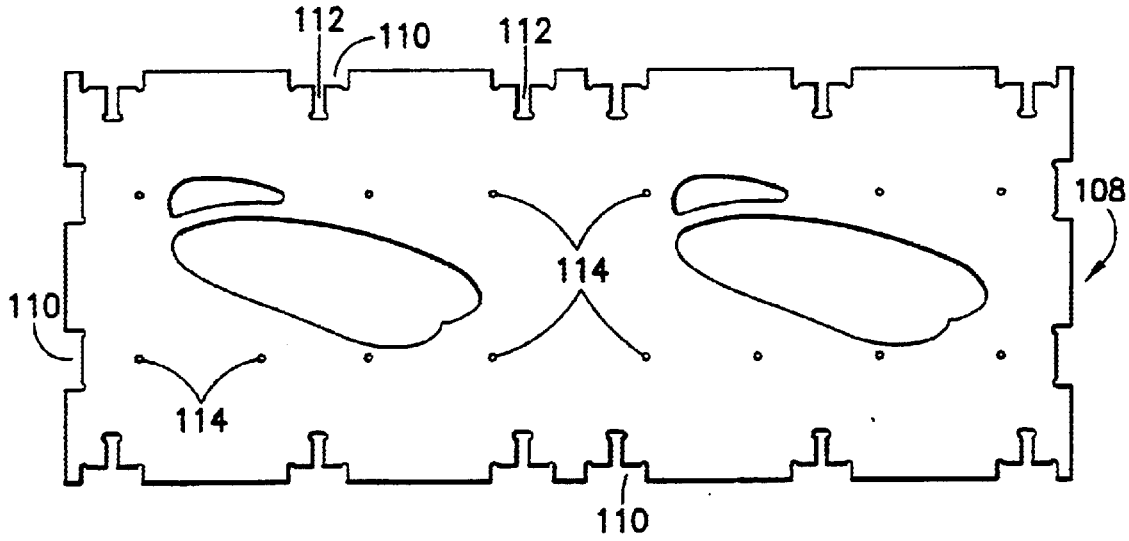

FIG. 18 shows a side panel 104 of a small platform component, FIG. 19 shows a side panel 106 of a medium platform component and FIG. 20 shows a side panel 108 of a large platform component. The differences between side panels 104, 106, 108 are the horizontal and vertical size and the number of notches in the side edges. Generally though, the side panels 104, 106, 108 each include apertures at the same height and spacing and notches at the same height to enable each side panel 104, 106, 108 to be connected to other ramp components by interconnection of side panels, cross-pieces or connection of a side panel to a cross-piece.

Each platform component provides a flat, elevated platform and includes a planar board (not shown) and a frame comprised of opposed, rectangular side panels 104, 106, 108, a support structure for supporting the board which is comprised of cross-pieces 14 which extend between the side panels and cross-piece supports 16 which extend between the side panels under the cross-pieces 14, and a connection structure comprised of cross-pieces 14. The support structure is arranged on one side of the frame and the connection structure encompasses the remaining sides of the frame so that as shown, at least one cross-piece 14 is situated on each side of the frame. The board can be connected to the cross-pieces 14 as discussed below and is optional in that it is not used when the platform component 62 is used as a support.

The cross-pieces 14 and cross-pieces supports 16 are the same as those used in the arcuate ramp component 10 and are described above.

The height of side panels 108 is preferably substantially the same as the height of the smaller side of the side panels 12 of the arcuate ramp component 10, as well as the height of the side panels 46 of the small box component 40, the side panels 68 of the wedge component 60 and the side panels 96 of the large wedge component. This enables the formation of ramp systems, support structure for decks and the like from various combinations of the box components, the wedge components, the arcuate ramp component 10 and the large platform component.

Side panels 104, 106, 108 each have a flat lower edge, flat side edges and a flat upper edge. Notches 110 are formed in the lower edge, side edges and upper edge, each notch 110 being sized to receive an indented part 14*a* of a respective cross-piece 14. Each notch 110 includes opposed surfaces extending substantially perpendicular to the edge of the side panel in which it is formed and a flat surface which is substantially parallel to the edge of the side panel in which the notch 110 is formed.

As shown in FIG. 18, the lower and upper edges of side panel 104 each include three notches 110 in order to receive three cross-pieces 14 and the side edges each include one notch 110 in order to receive one cross-pieces 14.

As shown in FIG. 19, the lower and upper edges of side panel 106 each include six notches 110 in order to receive six cross-pieces 14 and the side edges each include one notch 110 in order to receive one cross-pieces 14.

As shown in FIG. 20, the lower and upper edges of side panel 108 each include six notches 110 in order to receive six cross-pieces 14 and the side edges each include two notches 110 in order to receive two cross-pieces 14.

The number and spacing of the notches 110 can be varied as discussed above.

Notches 112 are formed in the flat surface of the notches 110 formed in the lower and upper edges of the side panels 104, 106, 108. Each notch 112 is sized to receive the indented part 16*a* of a respective cross-piece support 16. The combination of notches 110, 112 forms a T-shaped recess in the lower and upper edges of the side panels 104, 106, 108.

The side panels 104, 106, 108 also include apertures 114 at pre-determined locations to enable attachment of the platform components to other ramp components, for example, either to side panels of other ramp components or to cross-pieces of other ramp components (discussed below with reference to FIG. 23).

The boards used for the platform components (not shown) are dimensioned to overlie substantially the entire upper edge of each side panel 104, 106, 108. The boards are each provided with apertures which are designed to align with apertures 32 in the cross-pieces 14 of the support structure. During assembly of the platform components, countersunk connection members such as screws, nails and the like are placed in the aligning apertures to securely attach the board to the cross-pieces 14 placed in the notches 110 formed in the upper edges of the side panels 104, 106, 108.

The side panels 104, 106, 108, cross-pieces 14, cross-piece supports 16 and board (as well as the necessary fastening or connection members) are preferably sold together as a kit, with an appropriate number of each part to enable a complete platform component to be assembled. For example, a kit to assemble the large platform component would include two side panels 108, sixteen cross-pieces 14, six cross-piece supports 16 and a single board. Only six cross-piece supports 16 are needed as only one board is provided. Of course, for additional structural rigidity, six additional cross-pieces 16 could be provided.

In addition, boards or planks can be provided to overlie the side edges or the lower edge of the side panel. These boards or planks are connected to the cross-pieces along these edges of the side panels by locating apertures in the boards or planks designed to align with the apertures in the cross-pieces to thereby enable the placement of connection members between the aligning apertures.

To assemble the large platform component from the kit, the frame is first assembled. To this end, the side panels 82 are stood upright with the upper edge of the side panels 108 facing upward and the cross-piece supports 16 are placed in the notches 112. Cross-pieces 14 are then placed in the notches 110 over the cross-piece supports 16. Preferably fastening members are inserted through apertures 30 in the cross-pieces 14 to firmly secure the cross-pieces 14 to the side panels 108. The side panels 108 are then rotated until the lower edge faces upward. Cross-pieces 14 are snapped into the notches 110 in the lower edge of the side panels 108 and preferably fastened to the side panels 108 using fastening members. The side panels 108 are rotated until the side edges are facing upward and cross-pieces 14 inserted therein and fastened. It will be appreciated that cross-pieces 14 can be snapped into the notches 110 in the side edges even when the lower edge or upper edge faces upward. To complete assembly of the large platform component, the frame is turned over until the upper edge faces upward. The board is then placed over the cross-pieces 14 until apertures in the board align with apertures 32 in the cross-pieces 14 and then fastening members are inserted through the aligning apertures to secure the board to the cross-pieces 14. The large platform component is thus complete and ready for use.

Figure 21:
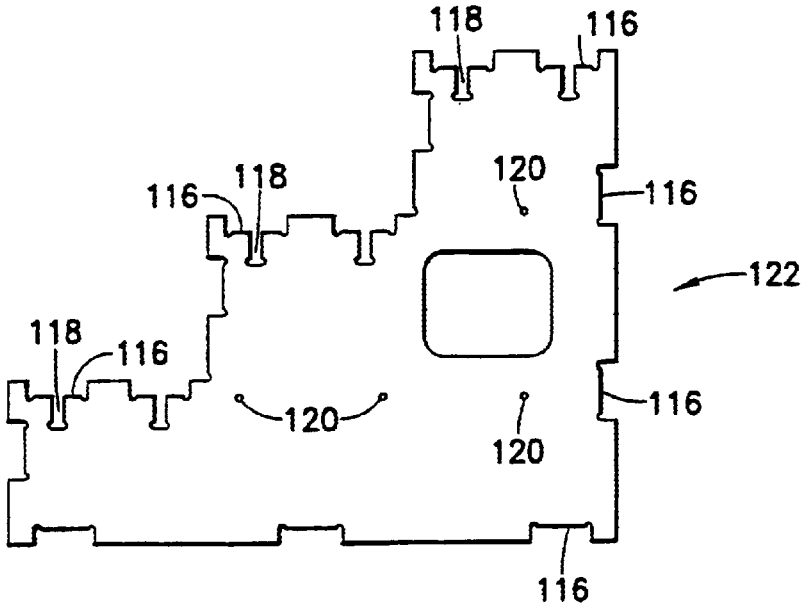

FIG. 21 shows a side panel 122 of a step component which provides three steps. Side panel 122 includes apertures 116 at the same height and spacing as the side panels of other ramp components and notches at the same height as the side panels of other ramp components to enable the side panel 122 to be connected to other ramp components by interconnection of side panels, cross-pieces or connection of a side panel to a cross-piece.

The step component includes at least three planar boards (not shown) and a frame comprised of opposed side panels 122, a support structure for supporting the boards which is comprised of cross-pieces 14 which extend between the side panels 122 and cross-piece supports 16 which extend between the side panels 122 under the cross-pieces 14, and a connection structure comprised of cross-pieces 14. The cross-pieces 14 and cross-pieces supports 16 are the same as those used in the arcuate ramp component 10 and are described above.

The height of side panels 122 may be the same as the height of the smaller side of the side panels 12 of the arcuate ramp component 10, as well as the height of the side panels 46 of the small box component 40, the side panels 68 of the wedge component 60 and the side panels 96 of the large wedge component. This enables the formation of ramp systems, support structure for decks and the like from various combinations of the box components, the wedge components, the arcuate ramp component 10 and the large platform component.

Side panels 122 each have a flat lower edge, a flat rear edge, three flat, upwardly facing edges and three flat forwardly facing edges, with the upward and forward facing edges defining steps. Notches 116 are formed in the edges, each notch 116 being sized to receive an indented part 14*a* of a respective cross-piece 14. Each notch 116 includes opposed surfaces extending substantially perpendicular to the edge of the side panel in which it is formed and a flat surface which is substantially parallel to the edge of the side panel in which the notch 116 is formed.

The lower edge of side panel 122 includes three notches 116 in order to receive three cross-pieces 14, the rear edge includes two notches 116 in order to receive two cross-pieces 14, the forward facing edges each include one notch in order to receive a cross-piece 14 and the upward facing edges each include two notches 116 to receive two cross-pieces 14. The number and spacing of the notches 116 can be varied.

Notches 118 are formed in the flat surface of the notches 116 formed in the upward facing edges of the side panel 122. Each notch 118 is sized to receive the indented part 16*a* of a respective cross-piece support 16. The combination of notches 116, 118 forms a T-shaped recess in the upward facing edges of the side panels 122.

The side panels 122 also include apertures 120 at pre-determined locations to enable attachment of the platform components to other ramp components, for example, either to side panels of other ramp components or to cross-pieces of other ramp components (discussed below with reference to FIG. 23).

The boards used for the step component are each dimensioned to overlie substantially an entire upward facing edge. The boards are each provided with apertures which are designed to align with apertures 32 in the cross-pieces 14 of the support structure. During assembly of the platform components, countersunk connection members such a, screws, nails and the like are placed in the aligning apertures to securely attach the boards to the cross-pieces 14 placed in the notches 116 formed in the upward facing edges of the side panel 122.

The side panels 122, cross-pieces 14, cross-piece supports 16 and boards (as well as the necessary fastening or connection members) are preferably sold together as a kit, with an appropriate number of each part to enable a complete step component to be assembled. Thus, a kit to assemble the step component would include two side panels 122, three boards, fourteen cross-pieces 14 and six cross-piece supports 16.

In addition, boards or planks can be provided to overlie the forward facing edges and rear edges of the side panel 122. These boards or planks are connected to the cross-pieces along these edges of the side panels by locating apertures in the boards or planks designed to align with the apertures in the cross-pieces to thereby enable the placement of connection members between the aligning apertures.

To assemble the step component from the kit, the frame is first assembled. To this end, the side panels 122 are stood upright with the upward facing edges of the side panels 122 facing upward and the cross-piece supports 16 are placed in the notches 118. Cross-pieces 14 are then placed in the notches 116 over the cross-piece supports 16. Preferably fastening members are inserted through apertures 30 in the cross-pieces 14 to firmly secure the cross-pieces 14 to the side panels 122. The side panels 122 are then rotated until the lower edge faces upward. Cross-pieces 14 are snapped into the notches 116 in the lower edge of the side panels 122 and preferably fastened to the side panels 122 using fastening members. The side panels 122 are rotated until the rear edge and forward facing edges are facing upward and cross-pieces 14 inserted therein and fastened. It will be appreciated that cross-pieces 14 can be snapped into the notches 116 in the rear edge and forward facing edges even when the lower edge or upper edge faces upward. To complete assembly of the step component, the frame is turned over until the upward facing edges face upward. The boards are then placed over the cross-pieces 14 until apertures in the boards align with apertures 32 in the cross-pieces 14 and then fastening members are inserted through the aligning apertures to secure the boards to the cross-pieces 14. The step component is thus complete and ready for use.

Figure 22:
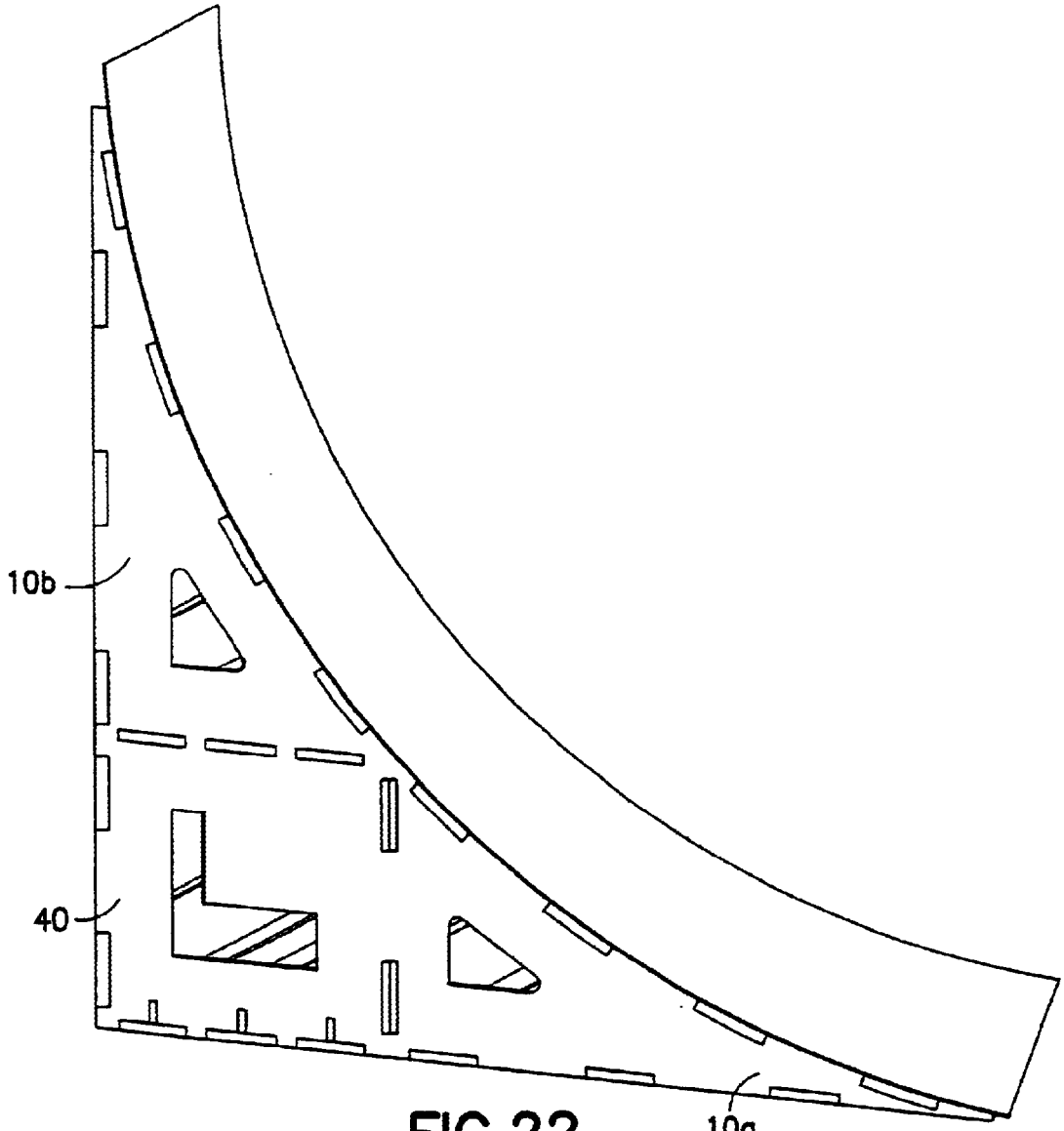
FIGS. 22–24 show additional embodiments of a ramp system in accordance with the invention which can be assembled using the ramps components shown in FIGS. 1 and 10.
Figure 23:
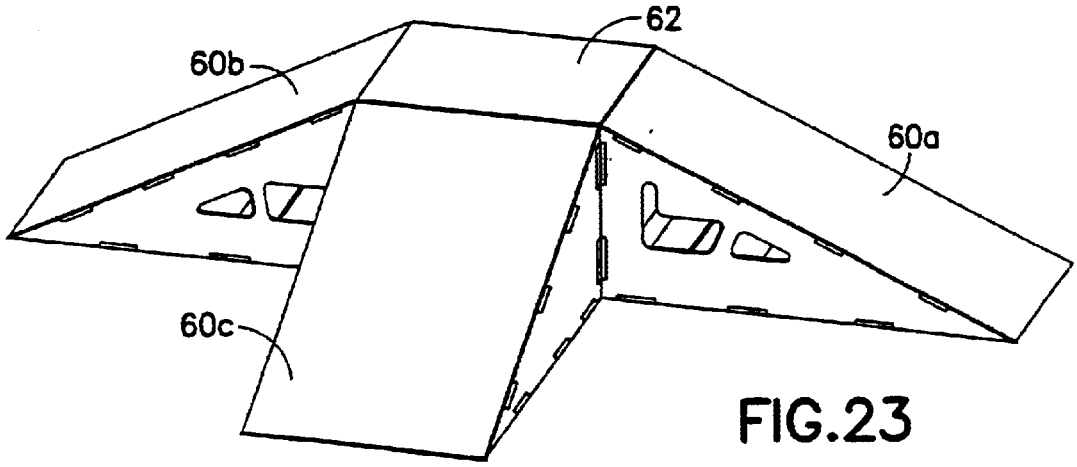
Figure 24:
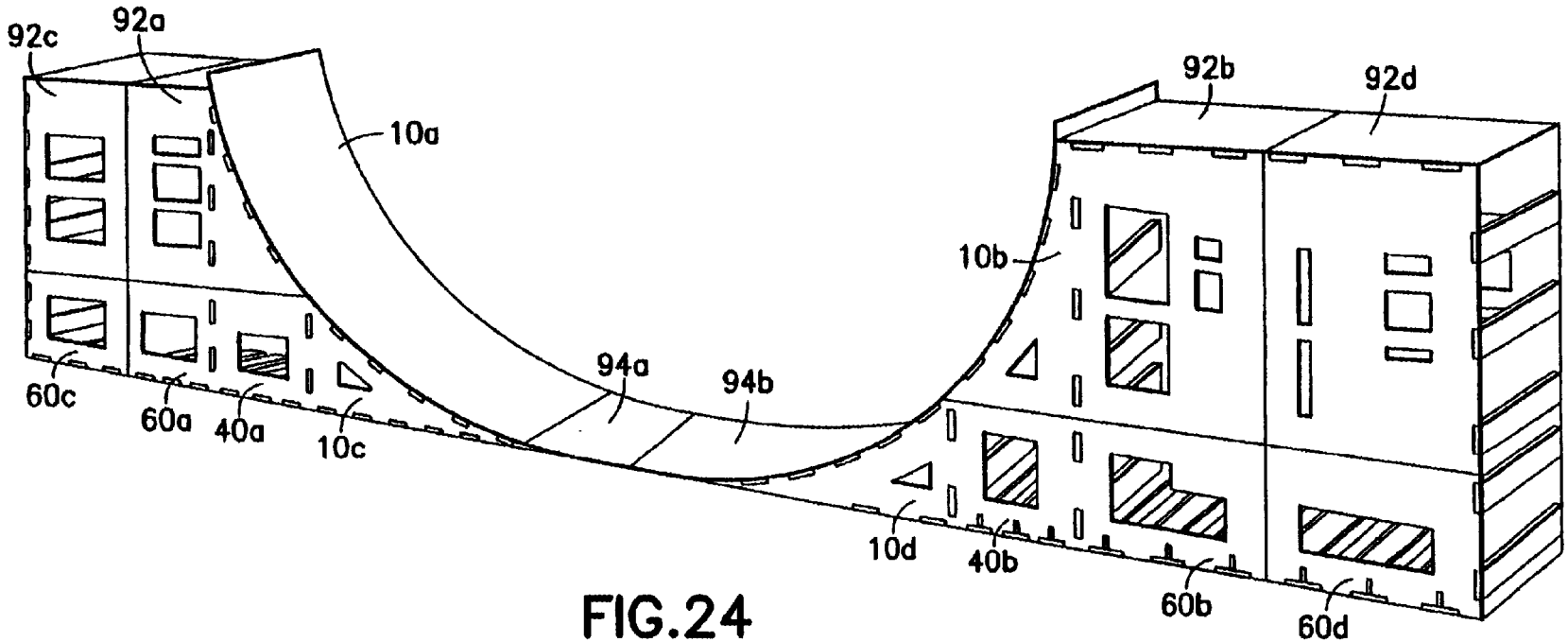

FIGS. 22–24 show some ramp systems which can be formed by the ramp components described above.

FIG. 22 shows a ramp system consisting of two arcuate ramp components 10*a*,10*b* and a small box component 40. To assemble this ramp system, the arcuate ramp components 10*a*,10*b* are assembled and the small box component 40 is assembled without a board, i.e., so that each edge of the side panels 46 is a connection edge. One arcuate ramp component 10*a* is placed with its larger edge on the ground and the small box component 40 is placed alongside the smaller edge of the arcuate ramp component 10*a* so that the apertures 26 in the cross-pieces 14 along the smaller edge align with apertures 26 in the cross-pieces 14 placed in a side connection edge 46*b* of the side panels 46 of the small box component 40. Fastening members 36*b* are inserted through the aligning apertures to securely connect the arcuate ramp component 10*a* and the small box component 40 together. The other arcuate ramp component 10*b* is placed with its smaller edge on the upper edge of small box component 40 so that the apertures 26 in the cross-pieces 14 along the smaller edge align with apertures 26 in the cross-pieces 14 placed in the upper edge 46*c* of the small box component 40. Fastening members 36*b* are inserted through the aligning apertures to securely connect the arcuate ramp component 10*b* and the small box component 40 together. The boards of each arcuate ramp component 10*a*,10*b* will align to provide a substantially contiguous arcuate ramp surface.

To disassemble the ramp system, the fastening members 36*b* are removed or untightened and the arcuate ramp components 10*a*,10*b* separated from the small box component 40. The arcuate ramp components 10*a*,10*b* and small box component 40 can then be used for other ramp systems.

The ramp system shown in FIG. 22 can be laterally expanded by placing one or more identical ramp systems alongside one another and connecting the side panels of the adjoining ramp components together. There may also be variations in the ramp systems placed alongside one another since the side panels of different ramp components may be connected together in view of the standard height and spacing of the apertures in the side panels.

FIG. 23 shows a ramp system consisting of three wedge components 60*a*, 60*b*, 60*c* and a large box component 62. This ramp system includes not only a connection between cross-pieces of adjacent ramp components, as in the ramp system shown in FIG. 22, but also a connection between cross-pieces of one ramp component and a side panel of another ramp component.

To assemble this ramp system, the wedge components 60*a*, 60*b*, 60*c* are assembled and the large box component 62 is assembled, with the optional board. One wedge component 60*a* is placed with its larger edge on the ground and the large box component 62 is placed alongside the smaller edge of the wedge component 60*a* so that the apertures 26 in the cross-pieces 14 along the smaller edge align with apertures 26 in the cross-pieces 14 placed in a side connection edge 82*b* of the side panels 82 of the large box component 62. Fastening members are inserted through the aligning apertures to securely connect the wedge component 60*a* and the large box component 62 together. Another wedge component 60*b* is placed with its larger edge on the ground on an opposite side of the large box component 62 from the wedge component 60*a* so that apertures 26 in the cross-pieces 14 along the smaller edge of wedge component 60*b* align with apertures 26 in the cross-pieces 14 placed in a side connection edge 82*b* of the side panels 82 of the large box component 62. Fastening members are inserted through the aligning apertures to securely connect the wedge component 60*b* and the large box component 62 together.

For the connection between cross-pieces of the wedge component 60*c* and a side panel 82 of the large box component 62, the third wedge component 60*c* is placed with its larger edge on the ground alongside one of the side panels 82 of the large box component 62. Apertures 26 in the cross-pieces 14 are situated to align with the apertures 88 in the side panels 82 and fastening members can be placed through the aligning apertures to fasten the cross-pieces 14 of the wedge component 60*c* to the side panel 82 of the large box component 62.

In this embodiment, the large box component 62 is dimensioned so that the length of the side panels is substantially equal to the length of the cross-pieces 14 and cross-piece supports 16. As such, the three wedge components 60*a*, 60*b*, 60*c* can be placed adjacent and connected to any of the sides of the large box component 62.

To disassemble the ramp system, the fastening members are removed or untightened and the wedge components 60*a*, 60*b*, 60*c* separated from the large box component 62. The wedge components 60*a*, 60*b*, 60*c* and large box component 62 can then be used for other ramp systems.

FIG. 24 shows a ramp system consisting of four arcuate ramp components 10*a*, 10*b*, 10*c*, 10*d*, two small box components 40*a*,40*b*, four large box components 60*a*, 60*b*, 60*c*, 60*d*, four large box extension components 92*a*, 92*b*, 92*c*, 92*d* and two flat surface components 94*a*, 94*b*. The large box extension components 92 are constructed and assembled in essentially the same manner as the large box component 60 except that the side panels are larger. The flat surface components 94 are flat boards.

To assemble this ramp system, the components requiring assembly are first assembled. Two arcuate ramp components 10 and one small box component 40 are combined together to form a ramp sub-assembly as shown in FIG. 22. The flat surface components 94*a*,94*b* are placed between the ramp sub-assemblies. A large box component 60*a*,60*b*, without the board, is connected to each small box component 40*a*, 40*b* and another large box component 60*c*,60*d*, without a board, is connected to each large box component 60*a*,60*b*. These connections involve placement of cross-pieces 14 of adjacent components alongside one another and insertion of fastening members through the aligning apertures 26 of the cross-pieces 14. The large box extension components 92*a*, 92*b*, 92*c*, 92*d* are connected to the underlying large box components 60*a*, 60*b*, 60*c*, 60*d*, respectively, and large box extension components 92*a*,92*b* are connected to the arcuate ramp components 10*a*,10*b*. These connections involve placement of cross-pieces 14 of adjacent components alongside one another and insertion of fastening members through the aligning apertures 26 of the cross-pieces 14. To disassemble the ramp system, the fastening members are removed or untightened and the ramp components separated from one another for possible use in other ramp systems.

The ramp system shown in FIG. 24 can be laterally expanded by placing one or more identical ramp systems alongside one another and connecting the side panels of the adjoining ramp components together. This will provide a wide ramp system which is particularly useful for skateboarding. There may also be variations in the ramp systems placed alongside one another since the side panels of different ramp components may be connected together in view of the standard height and spacing of the apertures in the side panels.

It will be appreciated by those skilled in the art that vastly more complex ramp systems can be formed using the ramp components described herein.

Advantages of the ramp system in accordance with the invention include the use of the same parts in different ramp components. That is, the cross-pieces 14 and cross-pieces supports 16 are used in connection with various side panels and board to form different ramp components. This reduces the number of parts of the ramp system and therefore makes manufacture of the ramp system easy and inexpensive.

The boards providing active ramp surfaces in the ramp system described herein can be made of a number of materials, including but not limited to, wood, plastic or a combination thereof. Further, the side panels, cross-pieces and cross-piece supports can be made of a number of materials including but not limited to wood and plastic. For manufacture of the boards, side panels, cross-pieces and cross-piece supports, a large sheet of raw material can be provided and the parts cut and/or drilled with a computer numeric controlled (CNC) device. This would eliminate significant waste and allow for a single operation manufacture from the sheets of raw material to the finished kit. Fastening members are added to the boxes of finished products along with assembly instructions.

For water use, a flotation device is placed underneath a ramp component and attached to the cross-pieces 14 placed in the notches in the lower edges of the side panels. Fastening members would be used to connect the apertures in the cross-pieces 14 to the flotation device, and optionally the apertures in the side panels and apertures in cross-pieces placed in notches in the side edges of the side panels. An anchoring system could be used and attached through the apertures in the cross-pieces and/or side panels. As such, the ramp system would be available for water sports.

The components described above are described for use in an amusement ramp. However, the same components could be selectively used to construct a deck, a support structure, a platform and other elevated or elevational structures. For example, a podium or platform could be formed from a number of box components or platform components having the same height and connected together via adjoining side panels or adjoining cross-pieces. The ramp components described herein are thus not limited to use for amusement ramps and can be used in numerous other applications.

In another embodiment of the invention, ramp components are formed from a skeleton of rigid supports connected together and covered by a board. The rigid supports may be metal rods having rows of apertures and connected at their ends to other metal rods. Nuts and bolts are used to fasten the metal rods together. The board may be a molded plastic unit adapted to cover the metal rod assembly, and which provides a curved, slanted or flat active ramp surface. Support plates are connected to the metal rods as necessary, e.g., along the side, to provide sufficient rigidity to the ramp. Different assemblies of metal rods and board can be provided, each in a different kit. Multiple ramp components could be connected together by passing the nuts and bolts through metal rods of adjacent ramp components.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. An amusement ramp system, comprising:

at least one ramp component each comprising:

a frame comprising a pair of substantially identical side panels, each of said side panels having a board supporting edge including notches;

a cross-piece support extending between and arranged in aligned pairs of said notches in said board supporting edges of said side panels; and a cross-piece extending between and arranged in the aligned pairs of said notches in said board supporting edges of said side panels over a respective one of said cross-piece supports such that said cross-piece supports support said cross-pieces; and a board connected to said cross-pieces and defining an active ramp surface.

2. The ramp system of claim 1, wherein said board supporting edge of each of said side panels is curved inward and said board is curved.

3. The ramp system of claim 1, wherein said side panels are substantially triangular, said board supporting edge being concave and a hypotenuse of said side panels.

4. The ramp system of claim 1, wherein said board supporting edge of each of said side panels is flat and said board is planar.

5. The ramp system of claim 1, wherein said side panels are substantially triangular, said board supporting edge being straight and a hypotenuse of said side panels.

6. The ramp system of claim 1, wherein said side panels further include at least one connection edge, each of said connection edges including notches, the frame further comprising a cross-piece extending between and arranged in aligned pairs of said notches in said connection edges of said side panels.

7. The ramp system of claim 1, further comprising connection means for connecting said cross-pieces to said board.

8. The ramp system of claim 7, wherein said cross-pieces include apertures and said board includes apertures in alignment with said apertures in said cross-pieces, said connection means comprising connection members extending through said aligning apertures.

9. The ramp system of claim 1, wherein said notches in said board supporting edge are T-shaped having a top portion adjacent said board supporting edge and a leg portion substantially perpendicular to said top portion, said cross-piece support being arranged to fit in said leg portion, said cross-piece being arranged to fir in said top portion.

10. The ramp system of claim 1, wherein said cross-piece supports are elongate and include a pair of indentations on a common edge each adjacent an end of said cross-piece support, said indentations defining an indented part of said cross-piece supports, said indented parts of said cross-pieces supports being arranged in said notches.

11. The ramp system of claim 1, wherein said cross-pieces are elongate and include a pair of indentations adjacent each end of said cross-piece, said indentations defining an indented part of said cross-pieces, said pair of indentations being situated on opposite edges of said cross-piece, said indented part of said cross-piece supports being inserted into said notches in said side panels.

12. The ramp system of claim 1, wherein said side panels are rectangular.

13. The ramp system of claim 1, wherein said notches in said board supporting edge and said cross-pieces are arranged such that said cross-pieces snap in to said notches.

14. The ramp system of claim 1, wherein said frame further comprises connection means for connecting said cross-pieces to said side panels.

15. The ramp system of claim 1, wherein said side panels and said cross-pieces include apertures, said notches in said board supporting edges of said side panels and said apertures in said side panels being positioned such that said apertures in said cross-pieces are alignable with said apertures in said side panels to thereby enable said side panels to be connected to cross-pieces of another ramp component.

16. The ramp system of claim 1, wherein said side panels include apertures positioned such that said apertures in one of said side panels are alignable with apertures in a side panel of another ramp component to thereby enable side panel of different ramp components to be connected to one another.

17. The ramp system of claim 16, further comprising spacers attachable to each of said side panels around a respective one of said apertures in said side panels and including an aperture in alignment with said respective aperture.

18. The ramp system of claim 1, wherein said cross-pieces include apertures, said notches in said board supporting edges of said side panels being positioned such that said apertures in said cross-pieces are alignable with apertures in cross-pieces of another ramp component to thereby enable cross-pieces of different ramp components to be connected to one another.

19. The ramp system of claim 1, further comprising:

a box component comprising a frame comprising a pair of substantially identical side panels, each of said side panels having connection edges including notches, and a cross-piece extending between and arranged in aligned pairs of said notches, said cross-pieces of said at least one ramp component and said cross-pieces of said box component being identical and including apertures; and connection members for connecting said at least one ramp component and said box component together, said connection members being arranged in said apertures in said cross-pieces of said at least one ramp component and aligning one of said apertures in said cross-pieces in said box component.

20. The ramp system of claim 1, wherein said side panels of said at last one ramp component include apertures, the ramp system further comprising:

a box component comprising a frame comprising a pair of substantially identical side panels, each of said side panels having apertures and connection edges including notches, and a cross-piece extending between and arranged in aligned pairs of said notches; and connection members for connecting said at least one ramp component and said box component together, said connection members being arranged in said apertures in one of said side panels of said at least one ramp component and aligning one of said apertures in one of said side panels of said box component alongside said one of said side panels of said at least one ramp component.

21. The ramp system of claim 1, wherein said at least one ramp component comprises two ramp components and said cross-pieces of said two ramp components include apertures, further comprising connection members for connecting said two ramp components together, said connection members being arranged in aligning pairs of said apertures in adjacent ones of said cross-pieces of said two ramp components.

22. The ramp system of claim 1, wherein said at least one ramp component comprises first and second ramp components, further comprising connection means for connecting one of said side panels of said first ramp component to one of said side panels of said second ramp component alongside said one of said side panels of said first ramp component.

23. The ramp system of claim 22, wherein said connection means comprises apertures arranged in said side panels of said first and second ramp components at a standard height and spacing and connection members arranged in aligning pairs of said apertures.

24. An amusement ramp system, comprising:

at least one ramp component each comprising:

a board defining an active ramp surface; and a frame comprising a pair of substantially identical side panels;

a support structure extending between and connected to said side panels, said support structure being connected to said board and supporting said board on said side panels; and connection means for enabling said frame to be connected to another ramp component, wherein said side panels include at least one connection edge, each of said at least one connection edge including notches, said connection means comprising a cross-piece extending between and arranged in aligned pairs of said notches in said at least one connection edge of said side panels.

25. The ramp system of claim 24, wherein each of said side panels has a board supporting edge including notches, said support structure comprising a cross-piece support extending between and arranged in aligned pairs of said notches in said board supporting edges of said side panels and a cross-piece extending between and arranged in the aligned pairs of said notches in said board supporting edges of said side panels over a respective one of said cross-piece supports such that said cross-piece supports support said cross-pieces.

26. The ramp system of claim 25, wherein each of said side panels includes apertures adapted to align with apertures in cross-pieces of the another ramp component to thereby enable said side panels to be connected to the cross-pieces of the another ramp component by placement of connection members in the aligning apertures.

27. The ramp system of claim 25, wherein each of said side panels includes apertures adapted to align with apertures in side panels of the another ramp component to thereby enable said side panels cc be connected to the side panels of the another ramp component by placement of connection members in the aligning apertures.

28. The ramp system of claim 25, wherein each of said cross-pieces includes apertures adapted to align with apertures of cross-pieces of the another ramp component to thereby enable said cross-pieces of said at least one ramp component to be connected to the cross-pieces of the another ramp component by placement of connection members in the aligning apertures.

29. The ramp system of claim 24, wherein said connection means comprises a cross piece having apertures adapted to align with apertures in the another ramp component to connection members in the aligning apertures.

30. The ramp system of claim 24, further comprising:

a box component comprising a board defining an active ramp surface and a frame comprising a pair of substantially identical side panels, a support structure extending between and connected to said side panels, said support structure being connected to said board and supporting said board on said side panels, and connection means for enabling said frame to be connected to said at least one ramp component.

31. The ramp system of claim 30, wherein said connection means of said at least one ramp component comprise cross-pieces extending between and connected to said side panels of said at least one ramp component and said connection means of said box component comprise cross-pieces extending between and connected to said side panels of said box component, said cross-pieces of said at least one ramp component and said cross-pieces of said box component including apertures, further comprising connection members arranged in said apertures in said cross-pieces of said at least one ramp component and aligning one of said apertures in said cross-pieces in said box component.

32. The ramp system of claim 24, wherein said at least one ramp component comprises two ramp components, said connection means of said two ramp components comprising cross-pieces extending between and connected to said side panels, said cross-pieces of said two ramp components including apertures, further comprising connection members arranged in aligning pairs of said apertures in said cross-pieces of said two ramp components.

33. The ramp system of claim 24, wherein said connection means comprise apertures in said side panels adapted to align with apertures of said frame of the another ramp component to thereby enable said side panels to be connected to said frame of the another ramp component by placement of connection members in said apertures of said side panels and aligning ones of said apertures in said frame of the another ramp component.

* * * * *